US007019719B2

(12) United States Patent
LeChevalier

(10) Patent No.: US 7,019,719 B2
(45) Date of Patent: Mar. 28, 2006

(54) METHOD AND CLAMPING APPARATUS FOR SECURING A MINIMUM REFERENCE VOLTAGE IN A VIDEO DISPLAY BOOST REGULATOR

(75) Inventor: Robert LeChevalier, Golden, CO (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 340 days.

(21) Appl. No.: 10/274,428

(22) Filed: Oct. 17, 2002

(65) Prior Publication Data

US 2003/0146784 A1 Aug. 7, 2003

Related U.S. Application Data

(60) Provisional application No. 60/342,637, filed on Oct. 19, 2001, provisional application No. 60/343,856, filed on Oct. 19, 2001, provisional application No. 60/343,638, filed on Oct. 19, 2001, provisional application No. 60/342,582, filed on Oct. 19, 2001, provisional application No. 60/346,102, filed on Oct. 19, 2001, provisional application No. 60/353,753, filed on Oct. 19, 2001, provisional application No. 60/342,793, filed on Oct. 19, 2001, provisional application No. 60/342,791, filed on Oct. 19, 2001, provisional application No. 60/343,370, filed on Oct. 19, 2001, provisional application No. 60/342,783, filed on Oct. 19, 2001, provisional application No. 60/342,794, filed on Oct. 19, 2001.

(51) Int. Cl.
*G09G 3/32* (2006.01)

(52) U.S. Cl. ..... 345/82

(58) Field of Classification Search ..... 345/82, 345/83, 211, 212

See application file for complete search history.

(56) References Cited

U.S. PATENT DOCUMENTS

| | | | | |
|---|---|---|---|---|
| 4,603,269 | A | 7/1986 | Hochstein | |
| RE32,526 | E | 10/1987 | Hochstein | |
| 5,162,688 | A | 11/1992 | Bouton | |
| 5,510,749 | A | 4/1996 | Arimoto | |
| 5,514,995 | A | 5/1996 | Hennig | |
| 5,537,073 | A | 7/1996 | Arimoto | |
| 5,672,992 | A | 9/1997 | Nadd | |
| 5,684,368 | A * | 11/1997 | Wei et al. | 315/302 |
| 5,689,208 | A | 11/1997 | Nadd | |
| 5,703,415 | A | 12/1997 | Tanaka | |
| 6,201,717 | B1 | 3/2001 | Grant | |

(Continued)

FOREIGN PATENT DOCUMENTS

EP 1 026 657 A2 8/2000

(Continued)

OTHER PUBLICATIONS

International Search Report dated Apr. 8, 2004 for International Application No. PCT/US02/33373.

(Continued)

*Primary Examiner*—Sumati Lefkowitz
*Assistant Examiner*—Rodney Amadiz
(74) *Attorney, Agent, or Firm*—Knobbe, Martens, Olson & Bear, LLP

(57) ABSTRACT

An apparatus for generating and providing a stable reference voltage to a boost regulator. The apparatus comprises a clamping circuit that is configured to receive a constant voltage and a variable voltage. The clamping circuit is further configured to generate the reference voltage based on the constant voltage and variable voltage. The clamping circuit provides the reference voltage to the boost regulator at a level that is at least sufficient to cause the boost regulator to output a non-zero voltage.

67 Claims, 11 Drawing Sheets

U.S. PATENT DOCUMENTS

| | | | |
|---|---|---|---|
| 6,229,508 | B1 | 5/2001 | Kane |
| 6,545,652 | B1 | 4/2003 | Tsuji |
| 2001/0024186 | A1 | 9/2001 | Kane et al. |
| 2003/0085854 | A1 | 5/2003 | Tsuji |

FOREIGN PATENT DOCUMENTS

| | | | |
|---|---|---|---|
| EP | 1 067 505 | A2 | 1/2001 |
| EP | 1 081 836 | A2 | 3/2001 |
| FR | 2 607 303 | | 11/1987 |
| GB | 2 337 354 | | 11/1999 |
| GB | 2 339 638 | A | 2/2000 |
| JP | 59-97223 | | 6/1984 |
| JP | 4-172963 | | 6/1992 |
| JP | 05102853 | | 4/1993 |
| JP | 7-322605 | | 12/1995 |
| JP | 11-330376 | | 11/1999 |
| WO | WO 98/52182 | | 11/1998 |
| WO | WO 01/27910 | A1 | 4/2001 |

OTHER PUBLICATIONS

International Search Report for International Application No. PCT/US02/33374, filed Oct. 17, 2002 dated May 30, 2003.

International Search Report for International Application No. PCT/US02/33427, filed Oct. 17, 2002, dated Jun. 5, 2003.

* cited by examiner

METHOD AND CLAMPING APPARATUS FOR SECURING A MINIMUM REFERENCE VOLTAGE IN A VIDEO DISPLAY BOOST REGULATOR

RELATED APPLICATIONS

This application claims priority to, and hereby incorporates by reference, the following patent applications:

U.S. Provisional Patent Application No. 60/342,637, filed on Oct. 19, 2001, entitled PROPORTIONAL PLUS INTEGRAL LOOP COMPENSATION USING A HYBRID OF SWITCHED CAPACITOR AND LINEAR AMPLIFIERS;

U.S. Provisional Patent Application No. 60/343,856, filed on Oct. 19, 2001, entitled CHARGE PUMP ACTIVE GATE DRIVE;

U.S. Provisional Patent Application No. 60/343,638, filed on Oct. 19, 2001, entitled CLAMPING METHOD AND APPARATUS FOR SECURING A MINIMUM REFERENCE VOLTAGE IN A VIDEO DISPLAY BOOST REGULATOR;

U.S. Provisional Patent Application No. 60/342,582, filed on Oct. 19, 2001, entitled PRECHARGE VOLTAGE ADJUSTING METHOD AND APPARATUS;

U.S. Provisional Patent Application No. 60/346,102, filed on Oct. 19, 2001, entitled EXPOSURE TIMING COMPENSATION FOR ROW RESISTANCE;

U.S. Provisional Patent Application No. 60/353,753, filed on Oct. 19, 2001 entitled METHOD AND SYSTEM FOR PRECHARGING OLED/PLED DISPLAYS WITH A PRECHARGE SWITCH LATENCY;

U.S. Provisional Patent Application No. 60/342,793, filed on Oct. 19, 2001, entitled ADAPTIVE CONTROL BOOST CURRENT METHOD AND APPARATUS, filed on Oct. 19, 2001;

U.S. Provisional Patent Application No. 60/342,791, filed on Oct. 19, 2001, entitled PREDICTIVE CONTROL BOOST CURRENT METHOD AND APPARATUS;

U.S. Provisional Patent Application No. 60/343,370, filed on Oct. 19, 2001, entitled RAMP CONTROL BOOST CURRENT METHOD AND APPARATUS;

U.S. Provisional Patent Application No. 60/342,783, filed on Oct. 19, 2001, entitled ADJUSTING PRECHARGE FOR CONSISTENT EXPOSURE VOLTAGE; and U.S. Provisional Patent Application No. 60/342,794, filed on Oct. 19, 2001, entitled PRECHARGE VOLTAGE CONTROL VIA EXPOSURE VOLTAGE RAMP;

This application is related to, and hereby incorporates by reference, the following patent applications:

U.S. Provisional Application No. 60/290,100, filed May 9, 2001, entitled "METHOD AND SYSTEM FOR CURRENT BALANCING IN VISUAL DISPLAY DEVICES";

U.S. Patent Application entitled "CURRENT BALANCING CIRCUIT", filed May 7, 2002 application Ser. No. 10/141,650;

U.S. Patent Application entitled "CURRENT BALANCING CIRCUIT", filed May 7, 2002 application Ser. No. 10/141,325;

U.S. patent application Ser. No. 09/904,960, filed Jul. 13, 2001, entitled "BRIGHTNESS CONTROL OF DISPLAYS USING EXPONENTIAL CURRENT SOURCE";

U.S. patent application Ser. No. 10/141,659, filed on May 7, 2002, entitled "MATCHING SCHEME FOR CURRENT CONTROL IN SEPARATE I.C.S.";

U.S. patent application Ser. No. 10/141,326, filed May 7, 2002, entitled "MATCHING SCHEME FOR CURRENT CONTROL IN SEPARATE I.C.S.";

U.S. patent application Ser. No. 09/852,060, filed May 9, 2001, entitled "MATRIX ELEMENT VOLTAGE SENSING FOR PRECHARGE";

U.S. Patent Application entitled "METHOD AND SYSTEM FOR PROPORTIONAL AND INTEGRAL LOOP COMPENSATION USING A HYBRID OF SWITCHED CAPACITOR AND LINEAR AMPLIFIERS", filed on even date herewith application Ser. No. 10/274,429;

U.S. Patent Application entitled "METHOD AND SYSTEM FOR CHARGE PUMP ACTIVE GATE DRIVE", filed on even date herewith application Ser. No. 10/274,488;

U.S. patent application Ser. No. 10/141,648, filed May 7, 2002, entitled "APPARATUS FOR PERIODIC ELEMENT VOLTAGE SENSING TO CONTROL PRECHARGE";

U.S. patent application Ser. No. 10/141,318, filed May 7, 2002, entitled "METHOD FOR PERIODIC ELEMENT VOLTAGE SENSING TO CONTROL PRECHARGE,";

U.S. Patent Application No. 10/274,489 filed Oct. 17, 2002, entitled "MATRIX ELEMENT PRECHARGE VOLTAGE ADJUSTING APPARATUS AND METHOD", filed on even date herewith;

U.S. Patent Application entitled "SYSTEM AND METHOD FOR EXPOSURE TIMING COMPENSATION FOR ROW RESISTANCE", filed on even date herewith application Ser. No. 10/274,491;

U.S. Patent Application entitled "METHOD AND SYSTEM FOR PRECHARGING OLED/PLED DISPLAYS WITH A PRECHARGE LATENCY", filed on even date herewith application Ser. No. 10/274,421;

U.S. Provisional Application No. 60/348,168 filed Oct. 19, 2001, entitled "PULSE AMPLITUDE MODULATION SCHEME FOR OLED DISPLAY DRIVER", filed on even date herewith;

U.S. patent application Ser. No. 10/029,563, filed Dec. 20, 2001, entitled "METHOD OF PROVIDING PULSE AMPLITUDE MODULATION FOR OLED DISPLAY DRIVERS";

U.S. patent application Ser. No. 10/029,605, filed Dec. 20, 2001, entitled "SYSTEM FOR PROVIDING PULSE AMPLITUDE MODULATION FOR OLED DISPLAY DRIVERS";

U.S. Patent Application entitled "ADAPTIVE CONTROL BOOST CURRENT METHOD AND APPARATUS", filed on even date herewith application Ser. No. 10/274,513;

U.S. Patent Application entitled "PREDICTIVE CONTROL BOOST CURRENT METHOD AND APPARATUS", filed on even date herewith application Ser. No. 10/274,490;

U.S. Patent Application entitled "RAMP CONTROL BOOST CURRENT METHOD", filed on even date herewith application Ser. No. 10/274,500;

U.S. Patent Application entitled "METHOD AND SYSTEM FOR ADJUSTING PRECHARGE FOR CONSISTENT EXPOSURE VOLTAGE", filed on even date herewith application Ser. No. 10/274,511;

U.S. Patent Application entitled "METHOD AND SYSTEM FOR RAMP CONTROL OF PRECHARGE VOLTAGE", filed on even date herewith application Ser. No. 10/274,502.

BACKGROUND OF THE INVENTION

1. Field of the Invention

This invention relates to display devices, and particularly to a clamping circuit for securing a minimum reference voltage of a boost regulator with a variable reference input in a display device.

2. Description of the Related Technology

Recently, there has been a great deal of development in the area of small flat-panel displays which require low power and are generally used for PDAs (Personal Digital Assistants), cellular telephones and automobile instrumentation, for example.

An OLED (Organic Light Emitting Diode) display or a PLED (Polymer Light Emitting Diode) is a well-known example of such small flat-panel displays. The OLED display is becoming widely used because it has many advantages such as low power consumption, full-color and wide viewing angle. Unlike a Liquid Crystal Display (LCD), the OLED is a current driven device. However, it is similarly arranged in a 2 dimensional array (matrix) of pixels to form a video display.

FIGS. 1A and 1B show typical physical structures of a PLED or OLED display device (Hereinafter PLED and OLED will be referred to as PLED for convenience). A representative series of row top electrodes 110, which include parallel conductors 111–118, are disposed on one side of a sheet of light emitting polymer 120. A representative series of column electrodes 138 that include parallel transparent conductors 131–138 are disposed on the other side of a light emitting polymer sheet 120, adjacent to a glass plate 140. Referring to FIG. 1B, a display cross-section 100 shows a drive voltage V 160 applied between a row 134 and a column 111. The potential developed between the row 111 and the column 134 across the thickness of the sheet 120 causes current flow through the sheet 120 and causes the light emitting polymer 120 to emit light. The emitted light 170 passes through the column conductor 134 which is transparent.

This structure results in a matrix of PLEDs, one PLED formed at each point where a row overlies a column. There will generally be M×N PLEDs in a matrix having M rows and N columns. Typical PLEDs function like light emitting diodes (LEDs), which conduct current and emit light when a voltage of one polarity is applied across them, and block current and stop emitting light when a voltage of the opposite polarity is applied. Exactly one PLED is common to both a particular row and a particular column, so as to control these individual PLEDs located at the matrix junctions. The PLED display device generally has two distinct driver circuits, one to drive the columns and the other to drive the rows. It is conventional to sequentially scan the rows (typically connected to the PLED cathodes) with a driver switch to a known voltage such as ground, and to provide another driver, which may be a current source, to drive the columns (which are typically connected to the PLED anodes).

A boost regulator is a circuit that automatically adjusts the amount of current flowing through a load in order to maintain a constant output voltage. The boost regulator performs such a function by comparing a reference voltage and an output sample voltage and generating a difference voltage between the two. A feedback control loop adjusts the regulator current output to minimize this difference, thereby achieving a constant output voltage. The boost regulator is used in many electronic devices.

The boost regulator is also used in the PLED display device and generates a drive voltage for the current source of the PLED display based on an input reference voltage. In some situations, it happens that the input reference voltage of the boost regulator is unstable or is too low so that the boost regulator can not provide a proper drive voltage for the current source.

Thus, what is needed in the art is an apparatus for providing a minimum stable reference voltage to a boost regulator.

SUMMARY OF THE INVENTION

In response to the needs discussed above, an apparatus is presented for securing a minimum reference voltage in a video display boost regulator. The invention may be embodied a number of ways.

One embodiment of the invention is that it provides a clamping apparatus which generates a stable minimum reference voltage which is provided to a boost regulator. The apparatus comprises a clamping circuit. The clamping circuit is configured to receive a constant voltage and a variable voltage and to generate a clamping voltage at a level that is at least sufficient to cause the boost regulator to output a non-zero voltage, and to provide the clamping voltage to the boost regulator as the reference voltage.

Another embodiment of the invention is to provide a display apparatus having at least one display element. The display apparatus comprises a boost regulator, a sampling circuit, a precharge circuit and a clamping circuit. The boost regulator receives a reference voltage and is configured to generate a drive voltage that is used for providing a current to the display element. The sampling circuit is configured to generate a representative display element voltage, which is created when a known current conducts through the display element. The precharge circuit is configured to generate a precharge voltage based on the representative display element voltage. The clamping circuit is configured to receive the precharge voltage and a constant voltage and to generate a clamping voltage at a level that is at least sufficient to cause the boost regulator to output a non-zero voltage, and to provide the clamping voltage to the boost regulator as the reference voltage.

A further embodiment of the invention is to provide a clamping apparatus which provides a reference voltage to a boost regulator that has an input terminal and is configured to generate a drive voltage for a current source based on the reference voltage. The apparatus comprises first and second input terminals, a clamping voltage generator and an output terminal. The first and second input terminals are configured to receive a constant voltage and a variable voltage, respectively. The clamping voltage generator is configured to generate a clamping voltage at a level that is at least sufficient to cause the boost regulator to output a non-zero voltage based on the constant and variable voltages. The output terminal is configured to provide the clamping voltage to the input terminal of the boost regulator.

Yet another embodiment of the invention is to provide a clamping apparatus that provides a reference voltage to a boost regulator that generates a drive voltage for a current source based on the reference voltage. The apparatus comprises a first voltage source configured to generate a constant voltage, a second voltage source configured to generate a variable voltage. The apparatus comprises a first modifying circuit connected to the first voltage source and configured to modify the constant voltage, and a second modifying circuit connected to the second voltage source and configured to modify the variable voltage. The apparatus also comprises a clamping circuit connected to outputs of the first and second modifying circuits, and configured to generate the reference voltage based on the modified constant voltage and the modified variable voltage, said reference voltage being provided to the boost regulator at a level that is at least sufficient to cause the boost regulator to output a non-zero voltage.

Still another embodiment of the invention is to provide a clamping apparatus that provides a reference voltage to a boost regulator that generates a drive voltage for a current source based on the reference voltage. The apparatus comprises a first voltage source configured to generate a constant voltage, and a second voltage source configured to generate a variable voltage. The apparatus also comprises a clamping circuit connected to an output of each of the first and second voltage sources, and configured to generate the reference voltage based on the constant and variable voltages, said reference voltage being provided to the boost regulator at a level that is sufficient to enable the operation of the boost regulator.

One aspect of the invention concerns a method for providing a reference voltage for a boost regulator that generates a drive voltage for a current source based on the reference voltage. The method comprises generating a constant voltage and generating a variable voltage. The method may further comprise generating the reference voltage based on the constant and variable voltages, wherein the reference voltage is at a level that is at least sufficient to cause the boost regulator to output a non-zero voltage. The method may also comprise providing the reference voltage to the boost regulator.

Another aspect of the invention is directed to a method of driving a display device having at least one display element and a boost regulator which generates a drive voltage for a current to the display element based on a reference voltage. The method comprises conducting a known current through the display element to generate at least a display element voltage. The method may also comprise sampling a representative voltage from the display element voltage, and providing a precharge voltage based on the representative voltage. The method may further comprise generating a constant voltage, and generating the reference voltage based on the precharge voltage and the constant voltage. The reference voltage being at a level that is at least sufficient to cause the boost regulator to output a non-zero voltage. The method may also comprise providing the reference voltage to the boost regulator.

One feature of the invention relates to a method for providing a reference voltage for a boost regulator that generates a drive voltage for a current source based on the reference voltage. The method comprises generating a constant voltage, generating a variable voltage, and modifying the constant voltage to a first predetermined voltage. The method further comprises modifying the variable voltage to a second predetermined voltage, and generating the reference voltage based on the first and second predetermined voltages. The reference voltage being at a level that is at least sufficient to cause the boost regulator to output a non-zero voltage. The method may also comprise providing the reference voltage to the boost regulator.

Another feature of the invention relates to a method for providing a reference voltage for a boost regulator that generates a drive voltage for a current source based on the reference voltage. The method comprises generating a constant voltage, and generating a variable voltage. The method further includes generating the reference voltage based on the constant and variable voltages, the reference voltage being at a level that is suitable to enable the operation of the boost regulator.

In one embodiment, the invention is directed to a method for providing a reference voltage for a boost regulator that generates a drive voltage for a current source based on the reference voltage. The method comprises generating a constant voltage, generating a variable voltage, and modifying the constant voltage to a first predetermined voltage. The method may further comprise modifying the variable voltage to a second predetermined voltage. The method may also comprise generating the reference voltage based on the first and second predetermined voltages, said reference voltage being at a level that is suitable to enable the operation of the boost regulator. The method may also comprise providing the reference voltage to the boost regulator.

BRIEF DESCRIPTION OF THE DRAWINGS

The foregoing and other features and objects of the invention will become more fully apparent from the following description and appended claims taken in conjunction with the following drawings, in which like reference numbers indicate identical or functionally similar elements.

DETAILED DESCRIPTION OF THE INVENTION

The embodiments described below overcome obstacles to providing proper drive voltage for the current source of the PLED display due to the unstable reference voltage of the boost regulator. However, the invention is more general than the embodiments which are explicitly described, and is not to be limited by the specific embodiments but rather is defined by the appended claims. In particular, the invention may be applied to other apparatus or boost regulators as long as the desired function of the invention is fulfilled.

Figure 1B:
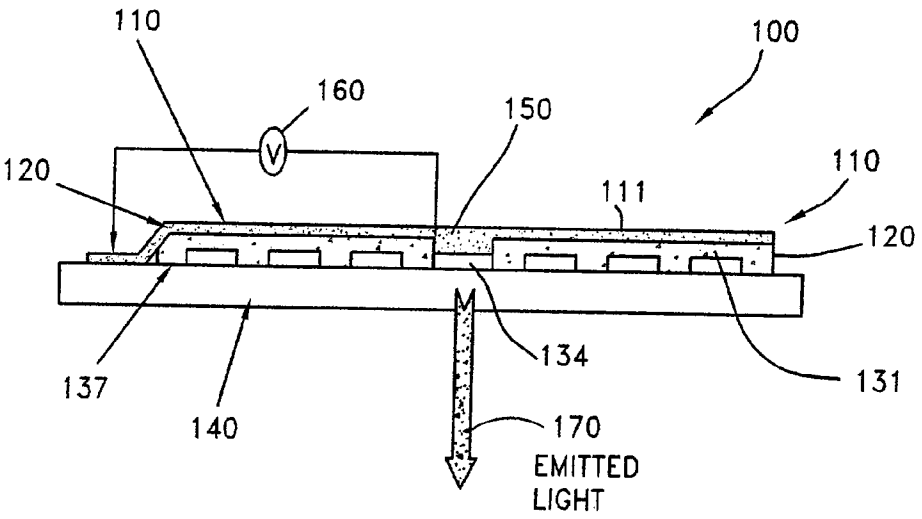
PRIOR ART FIG. 1B
FIG. 1B is a side elevation view of a PLED display device, showing a typical physical structure of the PLED display device.
Figure 1A:
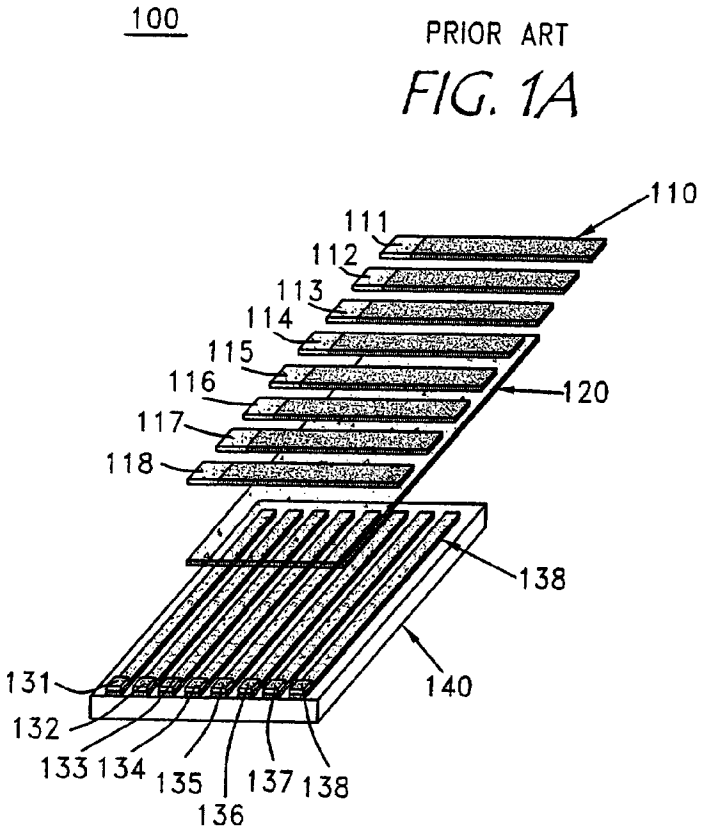
PRIOR ART FIG. 1A
FIG. 1A is an exploded perspective view of a PLED display device, showing a typical physical structure of the PLED display device.
Figure 2:
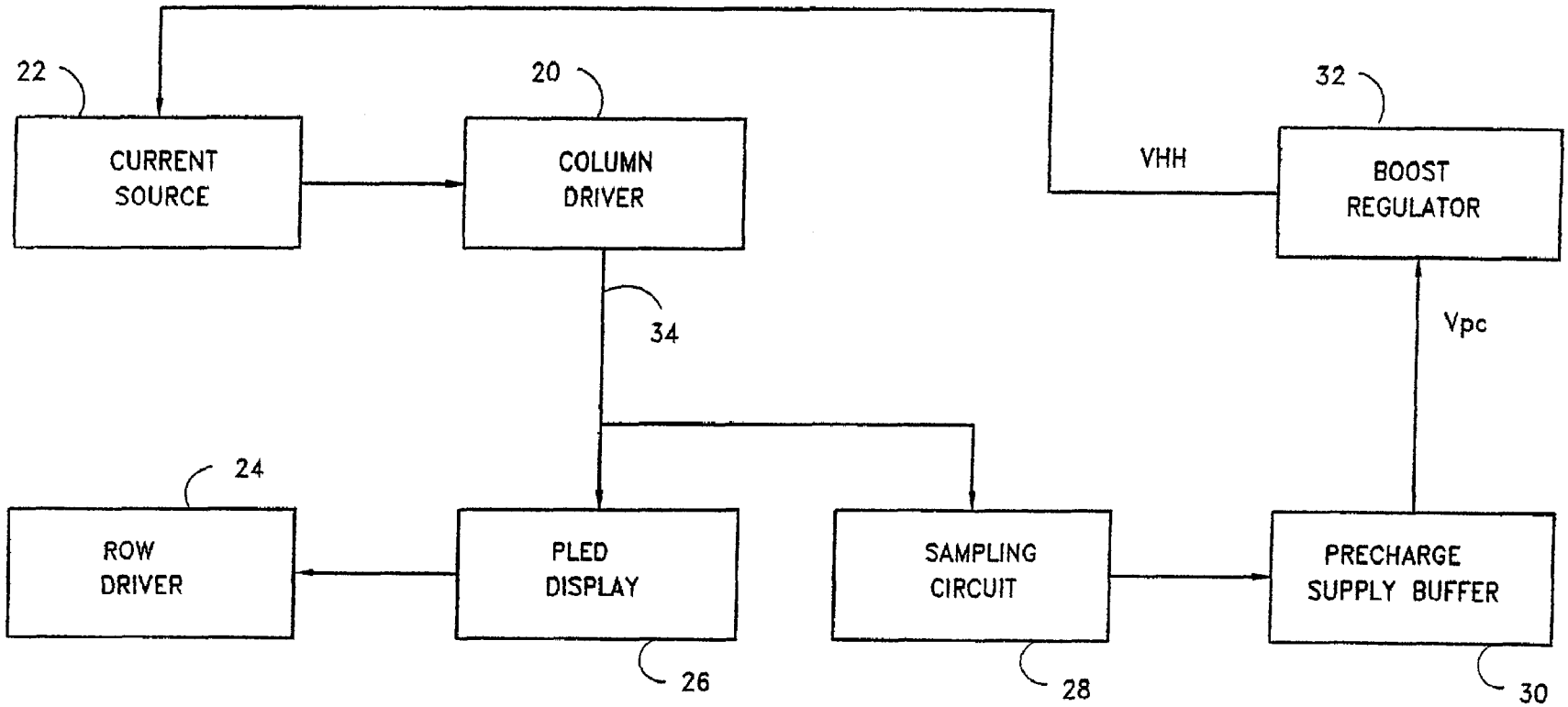
FIG. 2 is a block diagram of a typical PLED display device.
Figure 3:
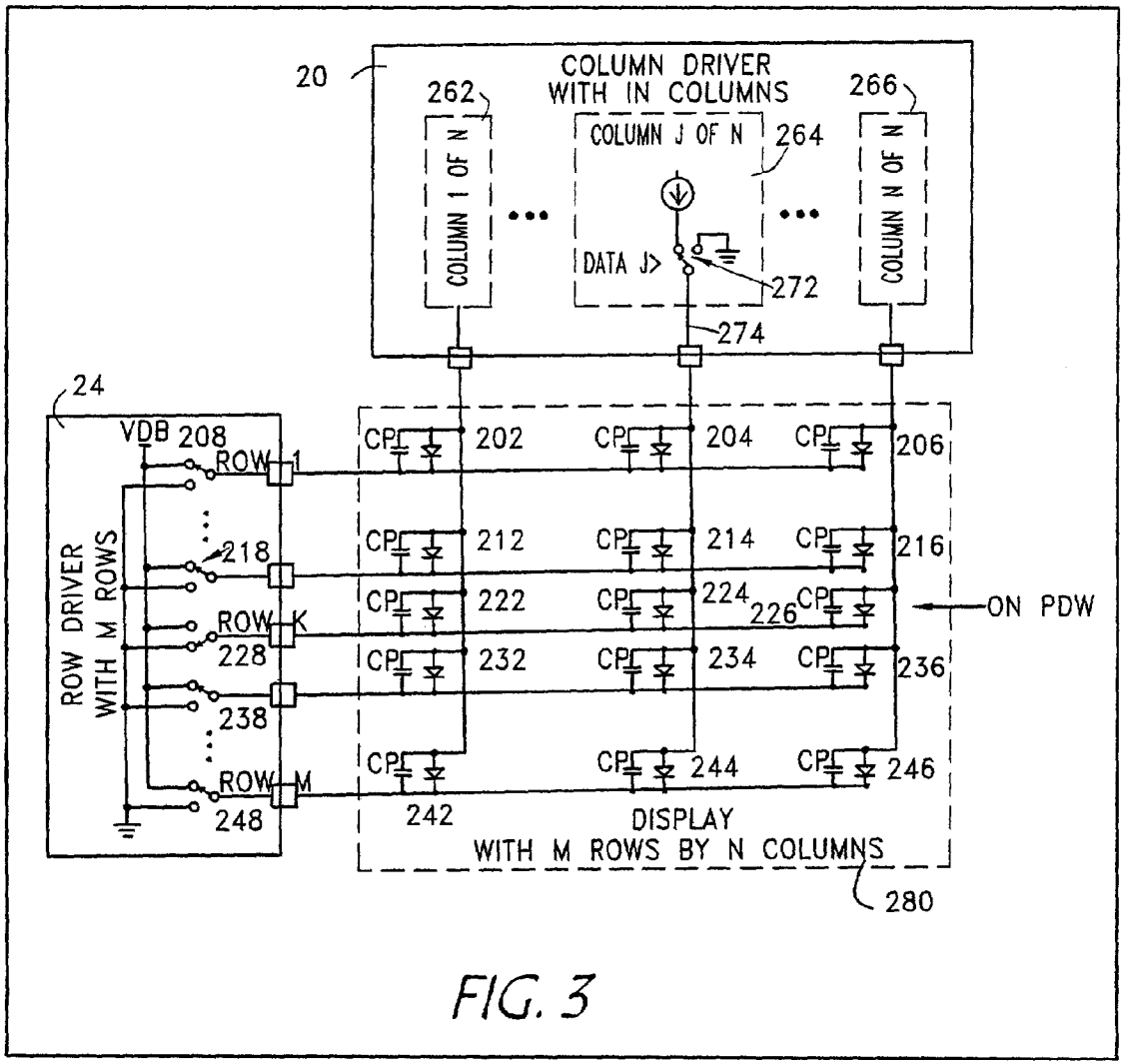
FIG. 3 is a schematic diagram illustrating the circuit structures of a column driver, a row driver and a PLED display.

Referring to FIG. 2, a current source 22 generates a current for driving a PLED display 26 based on a voltage VHH which is provided from a boost regulator 32. The current source 22 provides the current to a column driver 20. Referring to FIGS. 2 and 3, the column driver 20 comprises one column driver circuit (262, 264, 266) for each column. The column driver circuit 264 shows some of the details that are typically provided in each of the other column driver circuits (262, 266, . . . ), including the current provided from the current source 22, and a switch 272 which enables a column connection 34 to be connected to either the current or to ground. Specifically, each column driver circuit (262, 264, 266) is connected to the anodes of corresponding column PLEDs (202–242, 204–244, 206–246) so that the corresponding PLEDs (202–242, 204–244, 206–246) are provided with the current.

A row driver 24 includes representations of row driver switches (208, 218, 228, 238 and 248). The row switch 228 grounds row K to which the cathodes of PLEDs 222, 224 and 226 are connected during a scan of Row K. At the end of the scan period allowed for row K, the row switch 228 will typically disconnect the row from ground and apply VDD to the row instead. Then, the scan of the next row will begin, with the row switch 238 connecting the next row to ground, and the appropriate column drivers supplying the current to the desired PLEDs, e.g. 232, 234 and/or 236.

The PLED display 26 comprises M rows and N columns as shown in FIG. 3, though only five representative rows and three representative columns are shown. Each PLED is connected to a parasitic capacitor CP. It is assumed that the current from the current source 22 is provided to the anode of the PLED 224 while a ground is connected to the cathode of the PLED 224. This condition is maintained for a period of settling time, T which permits a steady state to be reached. However, the provided current will not flow through the PLED 224 until the parasitic capacitor "CP1" is first charged. When the steady state has been reached, all of the current from the current source 22 flows through the PLED 224 and no current flows through to the parasitic capacitor "CP1".

A sampling circuit 28 samples a PLED voltage at a point on the column connection 34 when the steady state has been reached for the voltage on the parasitic capacitor "CP1". When the steady state has been reached, the voltage of column connection 34 may be measured by for example, an analog to digital converter (not shown) and the digital voltage value may be stored in a memory (not shown). The sample voltage may change, for example, due to changes in the selected current, temperature, or age of the PLED. Typical desired PLED current can be between 1 ua and 1 ma. At approximately 100 μA and PLED steady state voltage is about 6 V at this current. The sampling circuit 28 is well known in the art and commercially available.

A precharge supply buffer 30 generates a precharge voltage Vpc based on the measured sample voltage. Vpc is ideally the voltage which causes the PLED 224 to begin immediately at the voltage which it would develop at the steady state when conducting the selected current. The reason why the precharge voltage Vpc is needed is that the current source 22 alone may be unable to bring a PLED from zero volts to operating voltage during the entire scan period because of the time necessary to charge the parasitic capacitor "CP1". Vpc may be selected to match the measured sample voltage as closely as possible. For example, Vpc may be obtained by converting the digital voltage value stored in the sampling circuit 28 to a corresponding analog voltage. The precharge supply buffer 30 provides the precharge voltage Vpc as a reference voltage Vref to the boost regulator 32. The precharge supply buffer 30 isolates the output of sampling circuit 28 from loading effects.

The boost regulator 32 generates a voltage VHH that enables the current source 22 to generate and provide the current to the column driver 20. In this manner the column driver may drive the PLED display 26. The boost regulator 32 generates VHH that is approximately 2V greater than the precharge voltage Vpc. The extra voltage provides compliance for the operation of the current source 22. However, as mentioned above, the measured sample voltage may be variable because the sample voltage may change due to the selected current, temperature, or age of the PLED. Since VHH is generally designed to track the PLED voltage to save power consumption, VHH should be variable. Here, the boost regulator 32 is well known in the art and commercially available.

Referring again to FIG. 2, a feedback control loop is formed through the PLED display 26, the sampling circuit 28, the precharge supply buffer 30, the boost regulator 32 and the column driver 20. As described before, initially at power-on, there is no current that is flowing through the PLED display 26 since the current is flowing to a parasitic capacitor until the steady state has been reached. So, at power up the sampling circuit 28 measures a zero voltage. Also, the output voltage Vpc of the precharge supply buffer 30 is zero. Here, the boost regulator 32 receives the sampled voltage or precharged voltage as its reference voltage (Vref). When zero voltage is input to the boost regulator 32, it may happen that the reference voltage Vref of the boost regulator 32 is zero. This means that the boost regulator 32 will try to regulate to a zero voltage output. Therefore, the current source 22 will have zero power VHH and, accordingly, this results in a zero current output from the current source 22. Thus, the PLED voltage remains at zero. That means the PLED display device will not operate during that timing period.

Therefore, one object of the invention is to provide a clamping circuit that guarantees a minimum reference voltage to the boost regulator. The minimum reference voltage is a certain level of voltage that is sufficient to enable the operation of the boost regulator while driving a PLED display device. The minimum reference voltage may also be a certain level of voltage that is at least sufficient to cause the boost regulator to output a non-zero voltage. For convenience, the minimum reference voltage will be referred to as Vmin hereinafter.

In one embodiment of the invention, the clamping circuit is associated with the boost regulator. For purposes of discussion, the clamping circuit is described herein in connection with the boost regulator used in the PLED/OLED display device. However, it will be appreciated that the clamping circuit is not limited to such a configuration, but is operated in connection with any of numerous components of the display device. That is, the clamping circuit of the invention may be used with any boost regulator as long as the boost regulator has a reference voltage input that is not high enough to enable the appropriate operation of the apparatus that includes the boost regulator.

Figure 4:
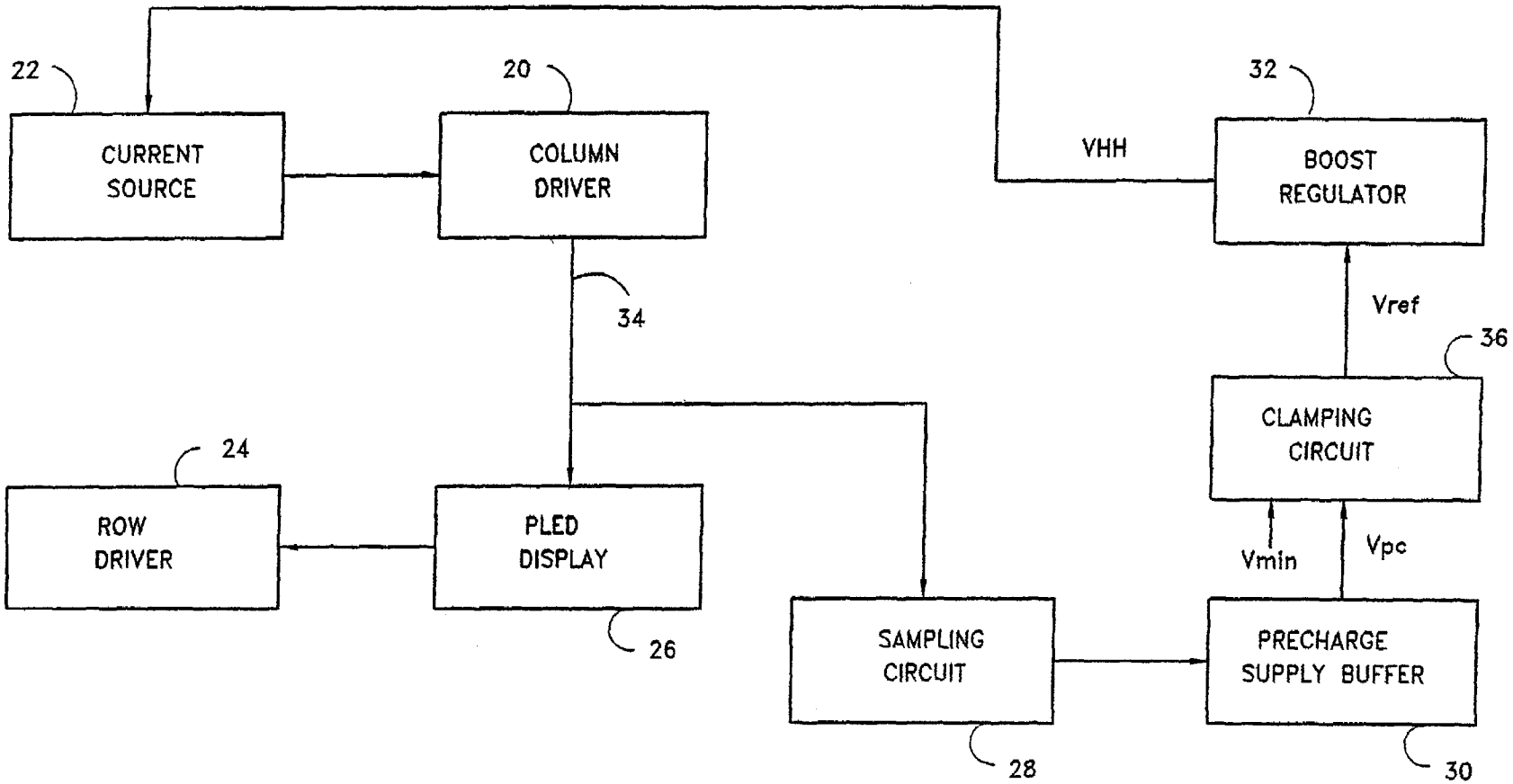
FIG. 4 is a block diagram of a PLED display device that comprises a clamping circuit according to the invention.

FIG. 4 illustrates a block diagram of the PLED display device that comprises a clamping circuit 36 according to the invention. In the illustrated embodiment, the clamping circuit 36 is connected between the precharge supply buffer 30 and the boost regulator 32. However, the PLED display device in FIG. 4 may be implemented without the precharge supply buffer 30. In that case, the clamping circuit 36 can generate Vref based on the column voltage sampled by the sampling circuit 28.

The clamping circuit 36 receives a precharge voltage Vpc from the precharge supply buffer 30 and a constant voltage Vmin from a constant voltage source that provides a fixed voltage reference. Here, the constant voltage source comprises a battery and any other voltage source that has a substantially steady state value. The clamping circuit 36 generates the minimum reference voltage Vref based on the precharge voltage Vpc and the constant voltage Vmin, and provides the reference voltage Vref to the boost regulator 32.

There are various methods that can generate and provide the minimum reference voltage for the boost regulator 32. One of these methods employs a clamping circuit 36 to compare the two input voltages Vpc and Vmin and transmit the greater of the two as the reference voltage. For example, if Vpc>Vmin, the clamping circuit 36 outputs Vpc as the reference voltage of the boost regulator 32. While, if Vmin>Vpc, the clamping circuit 36 outputs Vmin as the reference voltage of the boost regulator 32. In addition, if Vpc>Vmin, the clamping circuit 36 may output K×Vpc that is proportional to Vpc, where K is a constant Furthermore, if Vpc>Vmin, the clamping circuit 36 may output "Vpc−Vo", where Vo is a predetermined voltage, as long as "Vpc−Vo" satisfies the minimum reference voltage condition. Therefore, if a proper Vmin is selected, the start-up operation of the boost regulator 32 can be ensured.

In another embodiment, the clamping circuit 36 can include a programmed processor (not shown) that performs the above function. The processor may include, for example, a comparator (not shown) that compares Vpc and Vmin, an A/D converter (not shown) that converts Vpc and Vmin to digital data and a D/A converter (not shown) that converts the output digital data to an analog voltage signal for the reference of the boost regulator 32.

Figure 5:
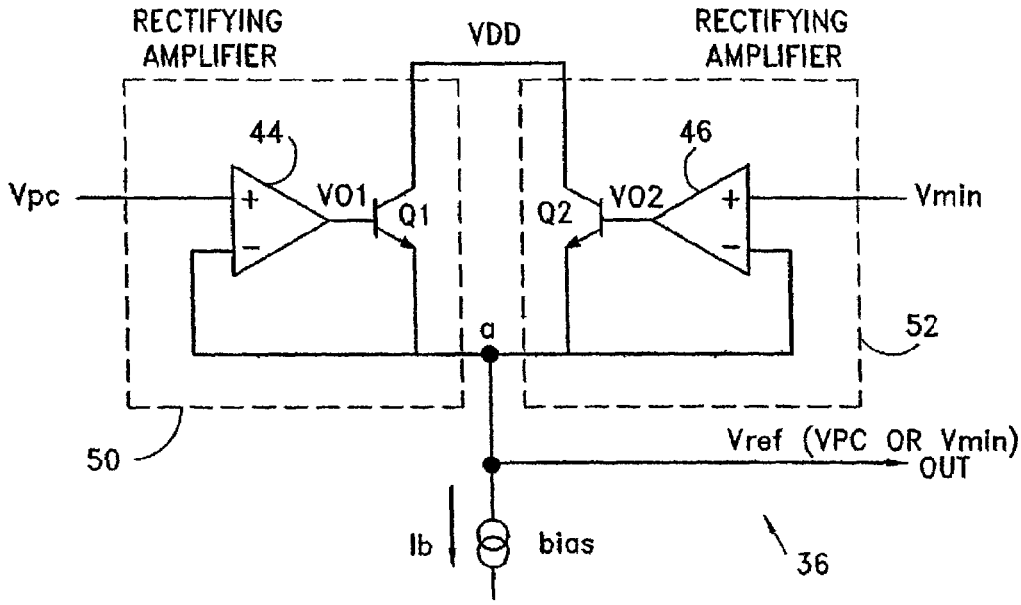
FIG. 5 is a schematic diagram illustrating the circuit structure of one embodiment of the clamping circuit.

FIG. 5 illustrates a circuit structure of one embodiment of the clamping circuit 36. The clamping circuit 36 comprises first and second rectifying amplifiers 50 and 52. Both rectifying amplifiers 50 and 52 are connected to each other at node "a". Each of the rectifying amplifiers 50 and 52 include opamps 44 and 46, and transistors Q1 and Q2, respectively. The positive input terminal of the opamp 44 is connected to the precharge supply buffer 30 and receives the precharge voltage Vpc. However, as discussed above, the positive input terminal of the opamp 44 may be connected to the sampling circuit 28 and may receive the sampled column voltage. The positive input terminal of the opamp 46 is connected to a constant voltage source that provides the fixed voltage reference Vmin. The two negative terminals of the opamps 44 and 46 are connected to each other. It can be seen that the opamps 44 and 46 mirror the two input voltages Vpc and Vmin to the output reference voltage Vref. The output terminals of the opamps 44 and 46 are connected to the bases of the transistors Q1 and Q2, respectively. The collectors and emitters of the two transistors Q1 and Q2 are common. The emitters of the two transistors Q1 and Q2 are connected to the output terminal of the clamping circuit 36. A current source Ib is connected to the node "a" and functions as a bias current.

Operation of the clamping circuit 36 may be explained by further reference to FIG. 5. For convenience, it is assumed that the outputs of the opamps 44 and 46 are Vo1 and Vo2, respectively, and that the voltage in node "a" is Va. Va is input to the negative terminals of the opamps 44 and 46.

Since the transistors Q1 and Q2 have a structure in which either one will operate at one time, if Vo1 is greater than Vo2, Q1 will be turned on and Q2 will be turned off. In this situation, the opamp 44 outputs "Vo1"[=A1×(Vpc−Va)], where A1 is a gain of the opamp 44 and Va=[Vo1−offset voltage (hereinafter referred to as 0.7V)]. Combining the above two, it is determined that Vo1={[A1/(A1+1)]×Vpc+0.7V}≅(Vpc+0.7 V), since A1 has a very large value in usual opamps, for example, 100,000. Therefore, it can be seen that "Va=Vref" equals Vpc.

If Vo2 is greater than Vo1, Q2 will be turned on and Q1 will be turned off. In this situation, the opamp 46 outputs "Vo2"[=A2×(Vmin−Va)], where A2 is a gain of the opamp 46 and Va=(Vo2−0.7V). In these circumstances, it is determined that "Vref=Va" equals Vmin. Consequently, the clamping circuit 36 outputs the greater input of the two inputs Vpc and Vmin. Irregardless of the value of Vpc, it is ensured that the voltage which is greater than Vmin or Vmin itself is provided to the boost regulator 32 as the reference voltage Vref thereof.

In the embodiment of FIG. 5, MOS transistors may be substituted for the bipolar transistors Q1 and Q2. In this situation, the outputs of the opamps 44 and 46 may be connected to a gate terminal of each MOS transistor. The drain terminals and the source terminals of the MOS transistors may be common. The source terminals of the MOS transistors may be connected to the output terminal of the clamping circuit 36.

Figure 6:
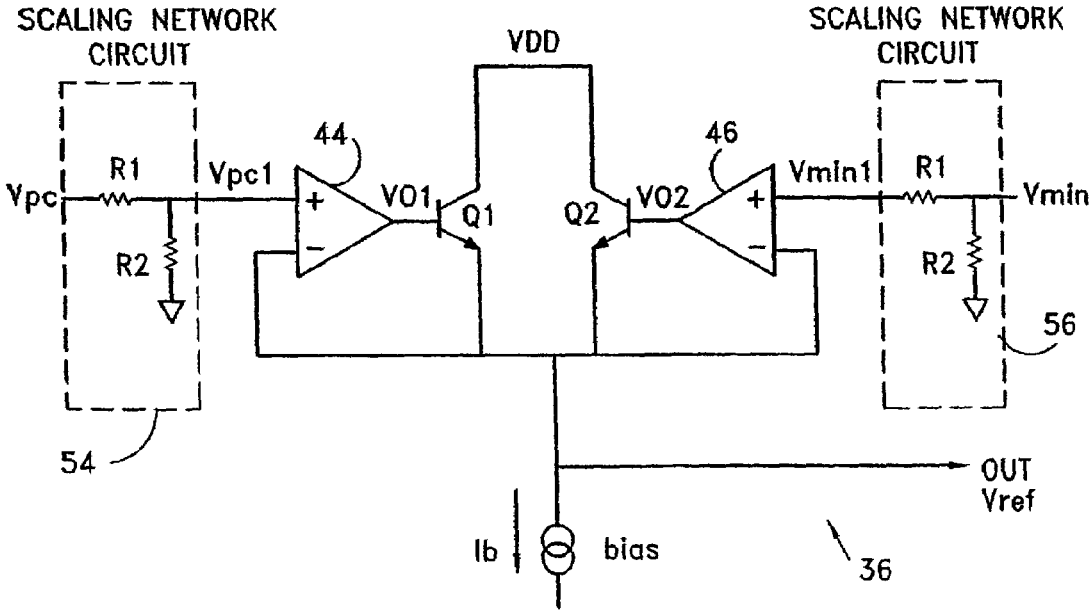
FIG. 6 is a schematic diagram illustrating the circuit structure of another embodiment of the clamping circuit.

FIG. 6 shows a schematic diagram of another embodiment of the clamping circuit 36. The clamping circuit 36 in FIG. 6 is the same as the one shown in FIG. 5 except for further comprising scaling network circuits 54 and 56. In this embodiment, Vpc and Vmin are scaled to appropriate values according to the values of resistors R1 and R2. The purpose of the scaling is to provide an appropriate reference voltage to the boost regulator 32. The scaled voltage of Vpc is (R2×Vpc)/(R1+R2) and hereinafter will be referred to as Vpc1. The scaled voltage of Vmin is (R2×Vmin)/(R1+R2) and hereinafter will be referred to as Vmin1. Vpc1 and Vmin1 are input to the opamps 44 and 46, respectively. In this case, Vmin should be set such that Vmin1 satisfies the minimum reference voltage for the boost regulator 32. The scaling network circuits 54 and 56 may be implemented as any electrical components so long as they satisfy the desired scaling effect with respect to Vpc and Vmin.

Figure 7:
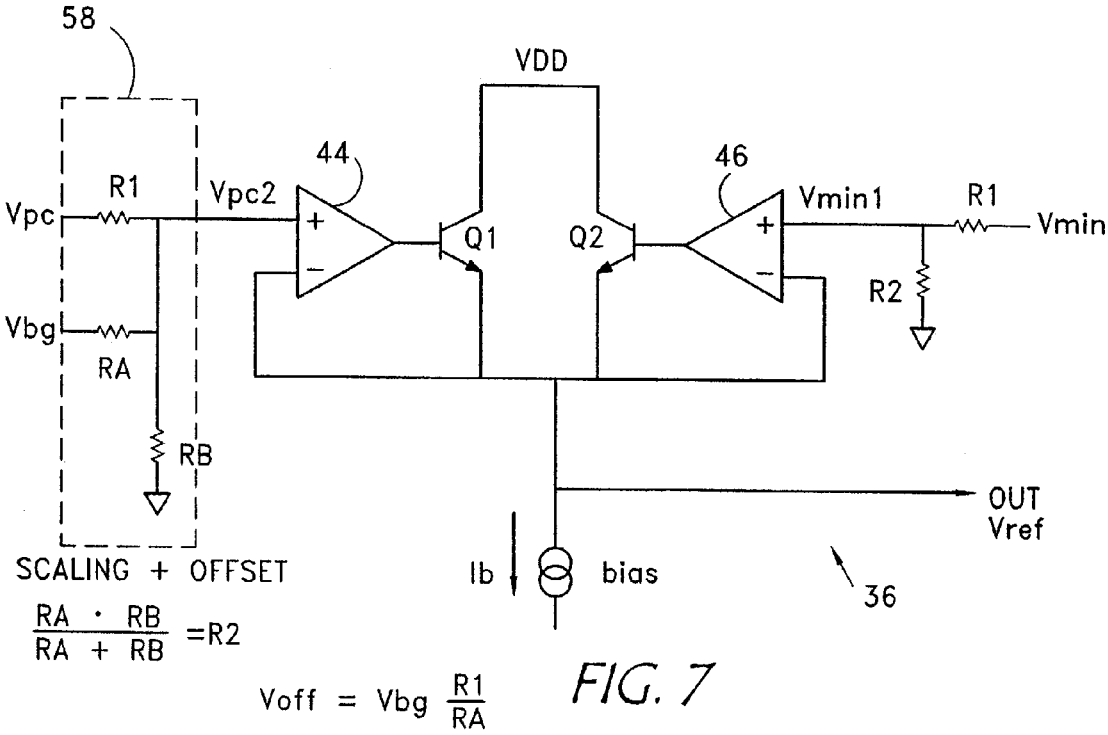
FIG. 7 is a schematic diagram illustrating the circuit structure of still another embodiment of the clamping circuit.

FIG. 7 shows a schematic diagram of another embodiment of the clamping circuit 36. The clamping circuit 36 in FIG. 7 has the same configuration as the one shown in FIG. 6 except that a scaling and offset circuit 58 has replaced the scaling network circuit 54. The scaling and offset circuit 58 scales Vpc to an appropriate value according to the values of resistors R1, RA, and RB. In addition, the scaling and offset circuit 58 provides an offset effect with respect to Vpc. Here, the offset effect means that Vpc is subtracted as much as a predetermined offset voltage (Voff) and "Vpc−Voff" is used in the clamping circuit 36. The purpose of the scaling and offset is also to provide an appropriate reference voltage to the boost regulator 32. The scaled voltage of Vpc is (R2×

Vpc)/(R1+R2), where R2=[(RA×RB)/(RA+RB)]. The offset voltage Voff is determined as [(Vbg×R1)/RA] in this embodiment, where Vbg is a constant voltage source. Combining the above two, Vpc2, the new input voltage of the opamp 44, will be {[(R2×Vpc)/(R1+R2)]−[(Vbg×R1)/RA]}. In this situation, if Vpc2>Vmin1, similarly to the operation discussed above, the clamping circuit 36 outputs Vpc2 as the reference voltage of the boost regulator 32. On the other hand, if Vmin1>Vpc2, the clamping circuit 36 outputs Vmin1 as the reference voltage of the boost regulator 32. In either case, it is ensured that the minimum reference voltage Vef is provided to the boost regulator 32.

Figure 8:
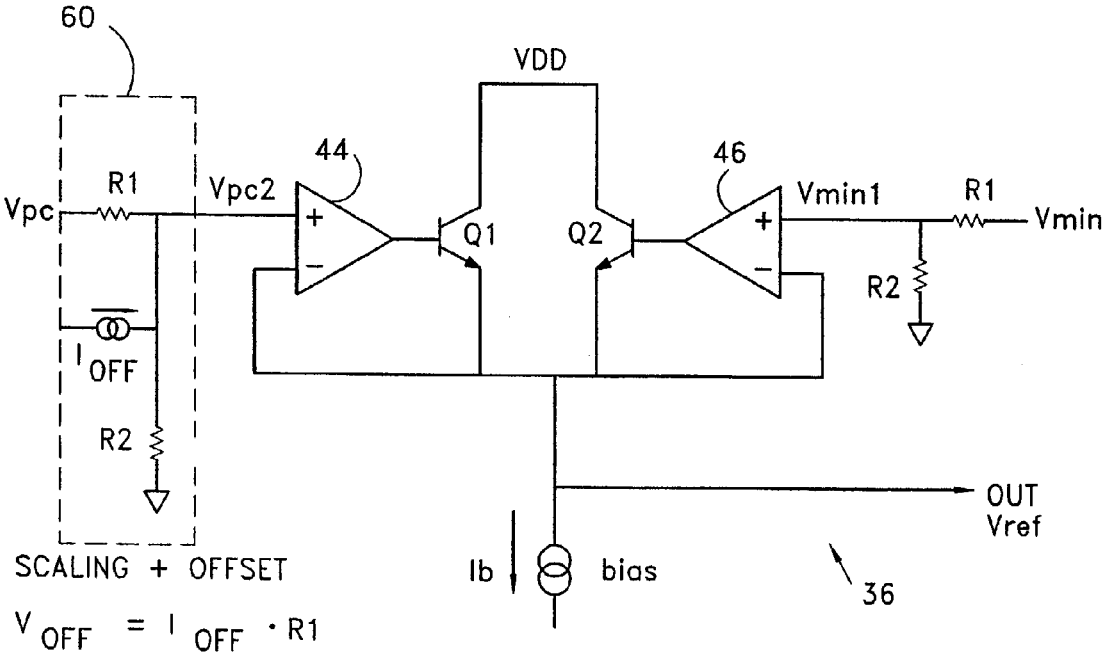
FIG. 8 is a schematic diagram illustrating the circuit structure of still another embodiment of the clamping circuit.

FIG. 8 shows a schematic diagram of another embodiment of the clamping circuit 36. The clamping circuit 36 in FIG. 8 is the same as the one shown in FIG. 6 except that a scaling and offset circuit 60 has replaced the scaling network circuit 54. Since the resistor R1 is connected between Vpc and the input terminal of the opamp 44, "Ioff×R1" acts as an offset voltage with respect to Vpc. The scaled voltage of Vpc in FIG. 8, which is the same as the one in FIG. 6, is (R2×Vpc)/(R1+R2). Combining the above two, Vpc2, the new input voltage of the opamp 44, will be {[(R2×Vpc)/(R1+R2)]−[Ioff×R1]}. In this situation, if Vpc2>Vmin1, similarly to the operation discussed above, the clamping circuit 36 outputs Vpc2 as the reference voltage of the boost regulator 32. On the other hand, if Vmin1>Vpc2, the clamping circuit 36 outputs Vmin1 as the reference voltage of the boost regulator 32. Either of these two cases satisfies the minimum reference voltage condition for the boost regulator 32.

Figure 9:
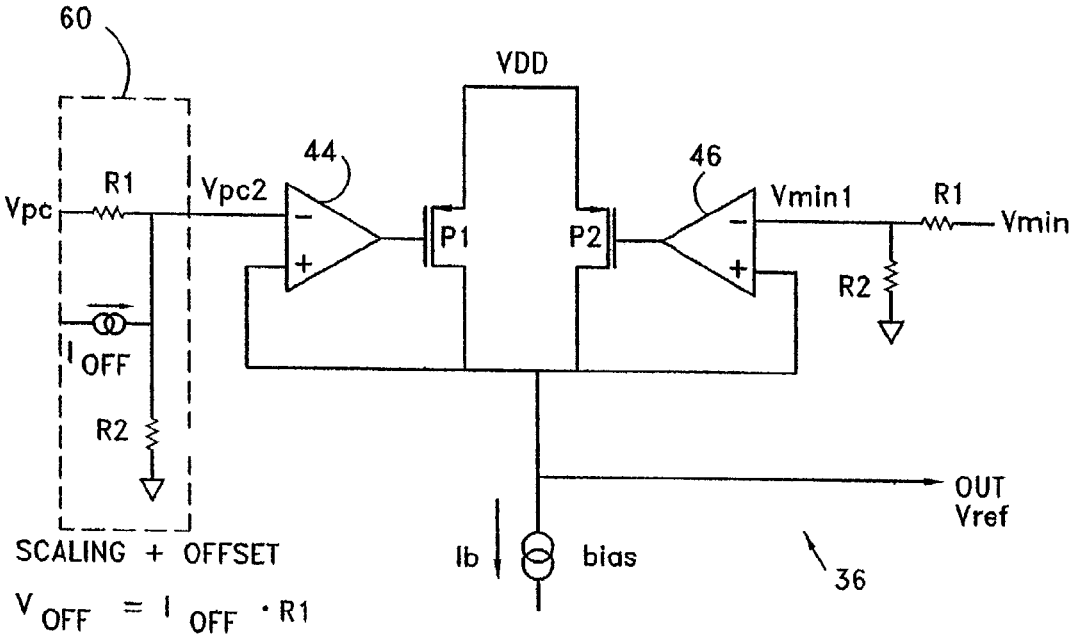
FIG. 9 is a schematic diagram illustrating the circuit structure of still another embodiment of the clamping circuit.

FIG. 9 shows a schematic diagram of another embodiment of the clamping circuit 36. The only difference between the clamping circuit in FIG. 9 and the one in FIG. 8 is that the bipolar transistors Q1 and Q2 have been replaced by PMOS transistors P1 and P2, and the polarities of the opamps 44 and 46 have been reversed in FIG. 10. However, NMOS transistors and the opamps 44 and 46 having the same polarity as the one in FIG. 8 may be used. In this embodiment, Vpc2 is input to the negative terminal of the opamp 44, and Vmin1 is input to the negative terminal of the opamp 46. The positive terminals of the opamps 44 and 46 are connected to each other. The operation of the clamping circuit 36 is the same as the one of the embodiment shown in FIG. 8. Therefore, a detailed description of the operation of the clamping circuit shown in FIG. 9 will be omitted.

Figure 10:
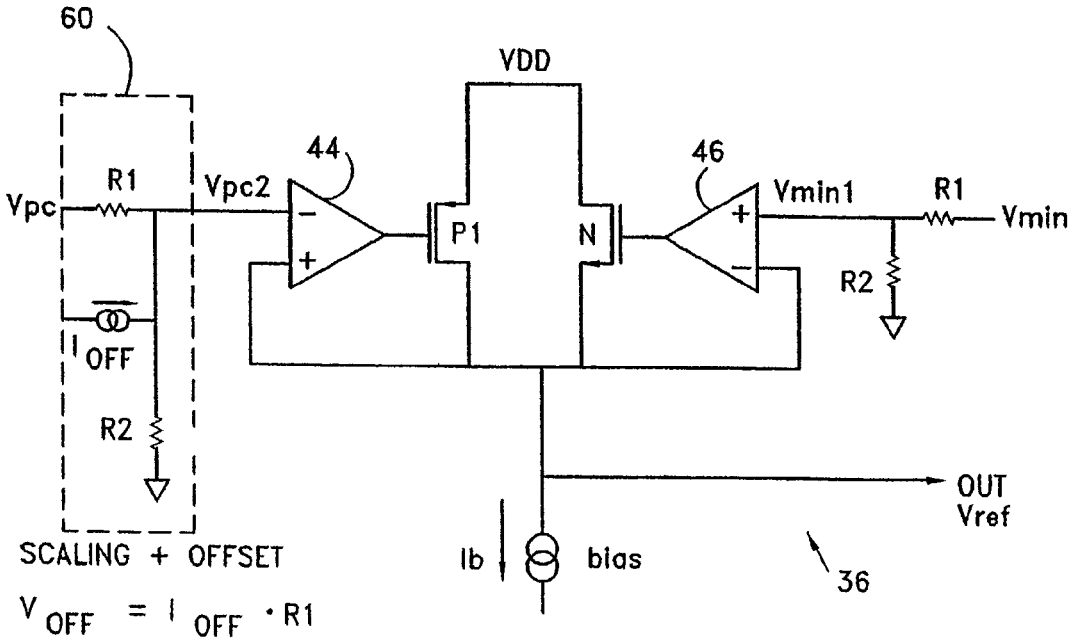
FIG. 10 is a schematic diagram illustrating the circuit structure of still another embodiment of the clamping circuit.

FIG. 10 shows a schematic diagram of another embodiment of the clamping circuit 36. The only difference between the clamping circuit in FIG. 10 and the one in FIG. 9 is that the PMOS transistor P2 has been replaced by NMOS transistor N, and the polarity of the opamp 46 has been reversed in FIG. 10. That is, the polarity of the opamp 46 is the same as the one of the embodiments shown in FIGS. 5-8. The remaining elements of the clamping circuit 36 are the same as those of the clamping circuit 36 shown in FIG. 9. Therefore, a detailed description of the operation of the clamping circuit shown in FIG. 10 will be omitted.

Figure 11:
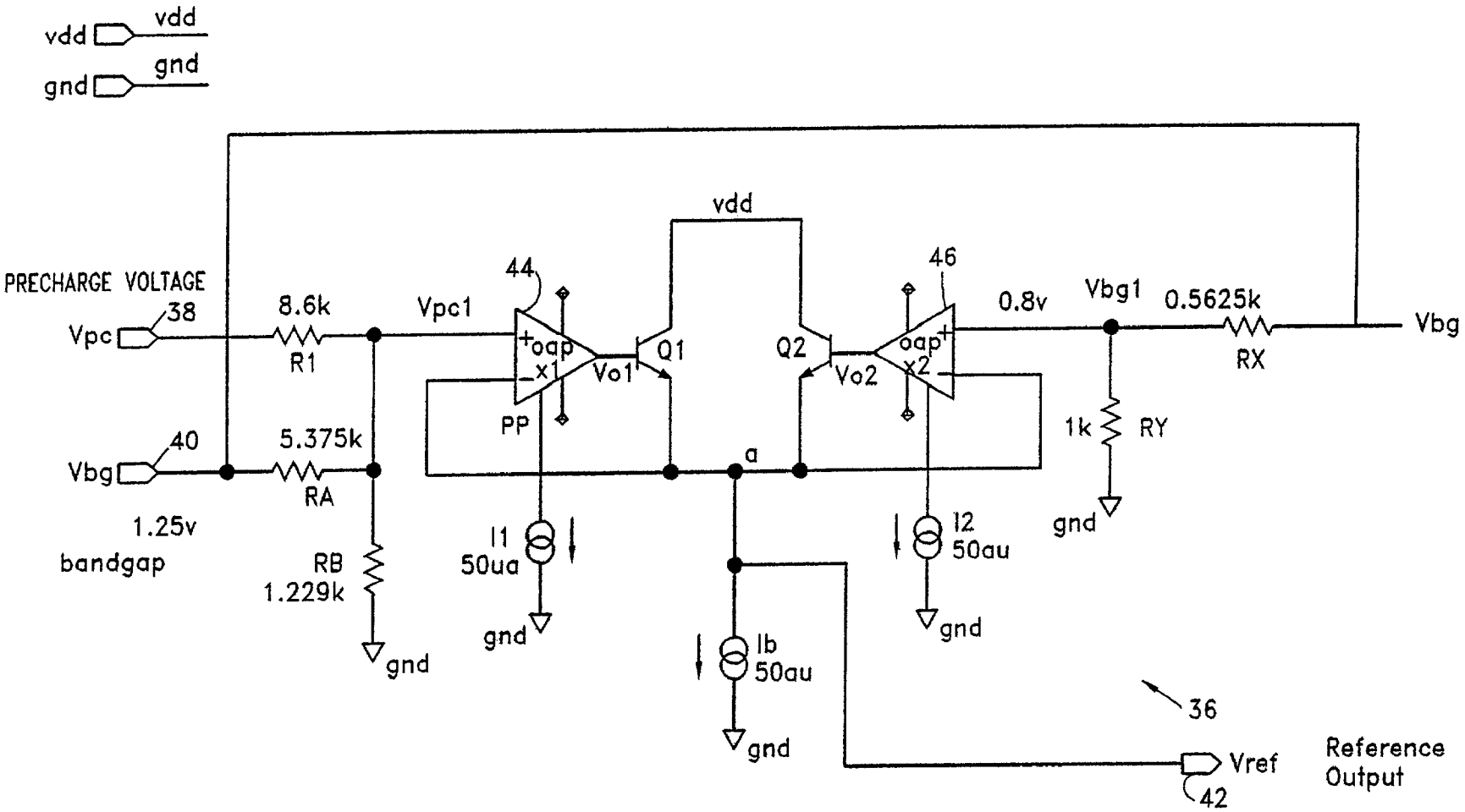
FIG. 11 is a schematic diagram illustrating the circuit structure of still another embodiment of the clamping circuit.

FIG. 11 shows a schematic diagram of another embodiment of the clamping circuit 36. The clamping circuit shown in FIG. 11 is similar to the one of FIG. 7. The clamping circuit 36 in FIG. 11 further comprises first and second input terminals 38 and 40, and an output terminal 42, and two current sources 11 and 12 connected to the opamps 44 and 46, respectively. Vmin in FIG. 7 has been replaced by Vbg in FIG. 11. That is, in FIG. 11 Vbg is used as Vmin as well as a voltage source for an offset voltage with respect to Vpc. In addition, the numerical values of R1, RA, RB, RX, and RY are exemplified in FIG. 11. The first input terminal 38 is connected to the output of the precharge supply buffer 30 or the sampling circuit 28. The second input terminal 40 is connected to a constant voltage source that provides the fixed voltage reference Vbg. The positive terminal of the first opamp 44 is connected to the first input terminal 38 through the resistor R1. The positive terminal of the second opamp 46 is connected to the second input terminal 40 through the resistor Rx. The negative terminals of the two opamps 44 and 46 are connected to each other. It can be seen that the opamps 44 and 46 mirror the two input voltages Vpc and Vbg to the output reference voltage Vref. The current sources 11 and 12 are connected to the negative terminals of the opamps 44 and 46. The current source 13 for bias is connected to the emitters of the transistors Q1 and Q2.

Operation of the clamping circuit 36 may be explained by further reference to FIG. 11. For convenience, it is assumed that the input voltages of the opamps 44 and 46 are Vpc1 and Vbg1, respectively, that have experienced a voltage drop by the scaling and offset effect as discussed above. Also, it is assumed that the outputs of the first and second opamps 44 and 46 are Vo1 and Vo2, respectively, and that the voltage in node "a" is Va. Va is input to both the negative terminals of the first and second opamps 44 and 46. Vpc1 is input to the positive terminal of the first opamp 44. Also, Vbg1, shown as 0.8V in FIG. 11, is input to the positive terminal of the second opamp 46.

As discussed with reference to the clamping circuit 36 shown in FIG. 5, if Vo1 is greater than Vo2, the clamping circuit 36 outputs Vpc1 as the reference voltage Vref through the output terminal 42 to the boost regulator 32. If Vo2 is greater than Vo1, the clamping circuit 36 outputs Vbg1 as the reference voltage Vref through the output terminal 42 to the boost regulator 32. Consequently, the clamping circuit 36 outputs the greater input of the two inputs Vpc1 and Vbg1. Since Vbg1 may be selected as a greater value than Vmin, it is ensured that the voltage which is greater than Vmin is provided to the boost regulator 32 as the reference voltage Vref thereof.

In the embodiment of FIG. 11, MOS transistors may be substituted for the bipolar transistors Q1 and Q2. In this situation, the outputs of the first and second opamps 44 and 46 may be connected to a gate terminal of each MOS transistor. The drain terminals and the source terminals of the MOS transistors may be common. The source terminals of the MOS transistors may be connected to the output terminal 42.

Figure 12:
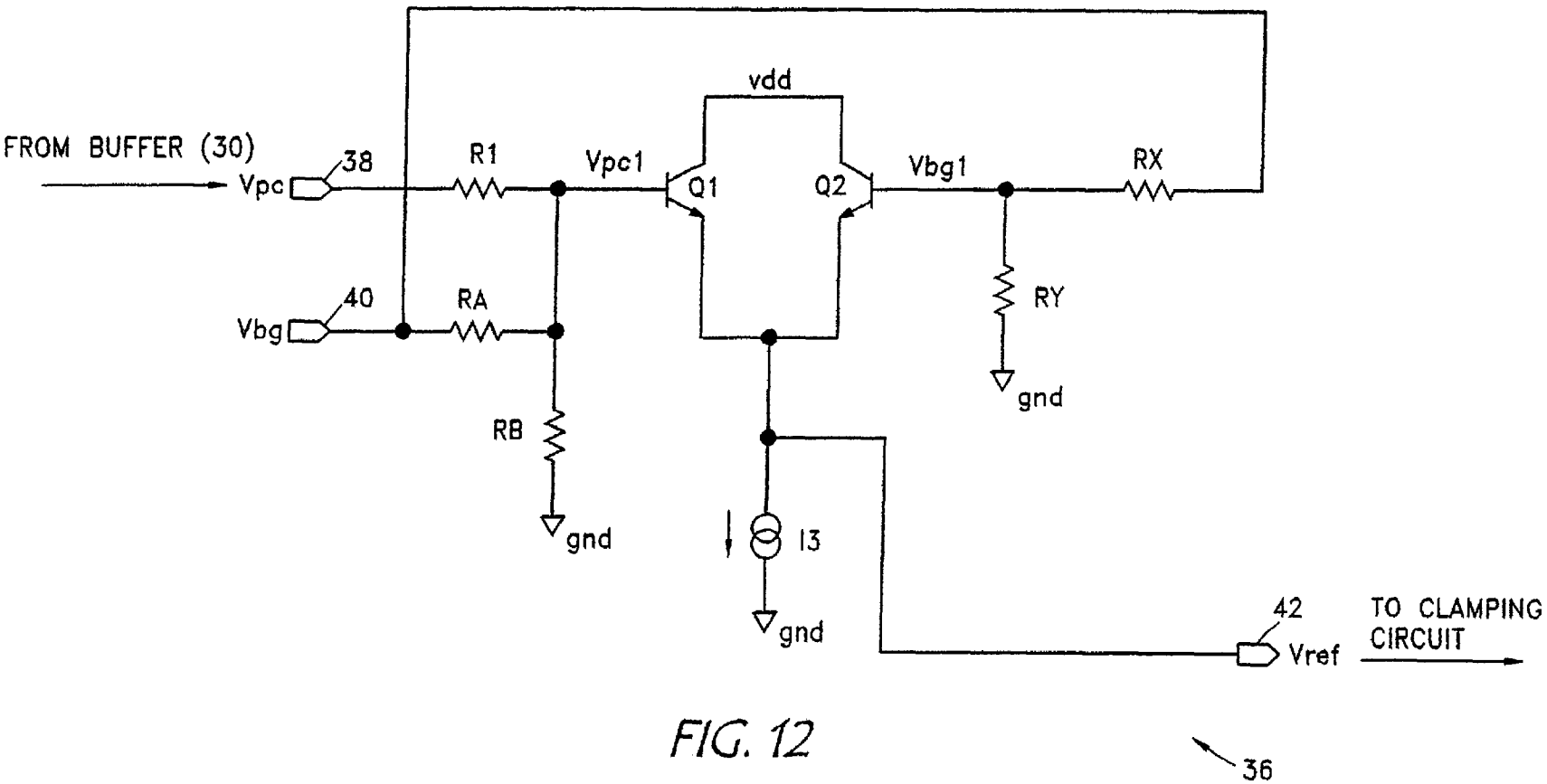
FIG. 12 is a schematic diagram illustrating the circuit structure of still another embodiment of the clamping circuit.

FIG. 12 shows a schematic diagram of another embodiment of the clamping circuit 36. The clamping circuit 36 in FIG. 12 is implemented without the opamps 44 and 46. This embodiment assumes that an input voltage to the transistor Q1 is Vpc1 and an input voltage to the transistor Q2 is Vbg1. If Vpc1>Vbg1, Vref is obtained as [Vpc1−0.7 V]. If Vbg1>Vpc1, Vref is found to be [Vbg1−0.7 V]. If proper resistor values are selected for R1, RA, RB, RX and RY, Vref is found to be (Vpc1−0.7 V) which is greater than Vmin. Also, Vref is obtained by the relationship (Vbg1−0.7 V) which is greater than Vmin. Here, MOS transistors may also be substituted for the bipolar transistors Q1 and Q2.

Figure 13:
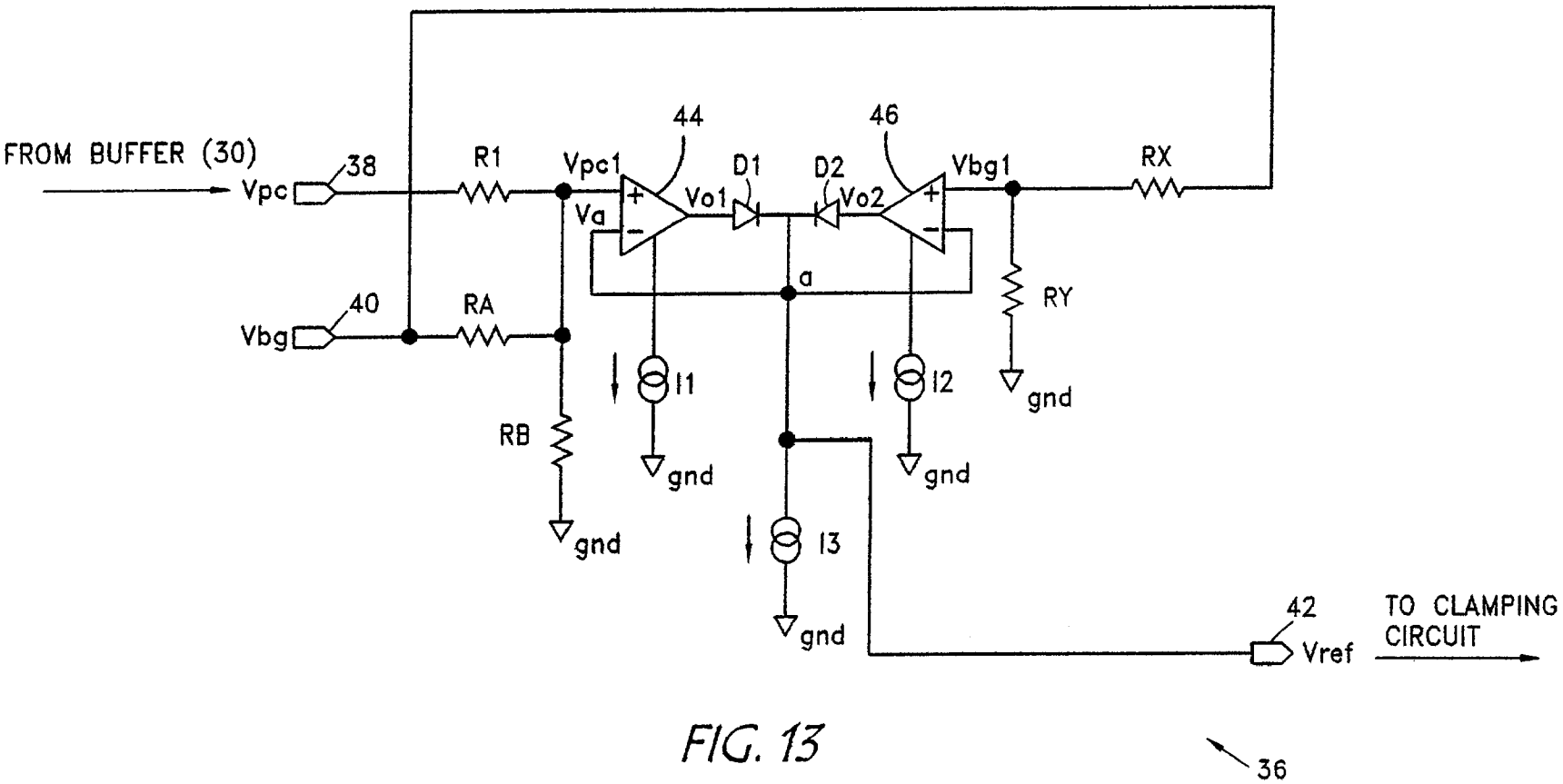
FIG. 13 is a schematic diagram illustrating the circuit structure of still another embodiment of the clamping circuit.
Figure 14:
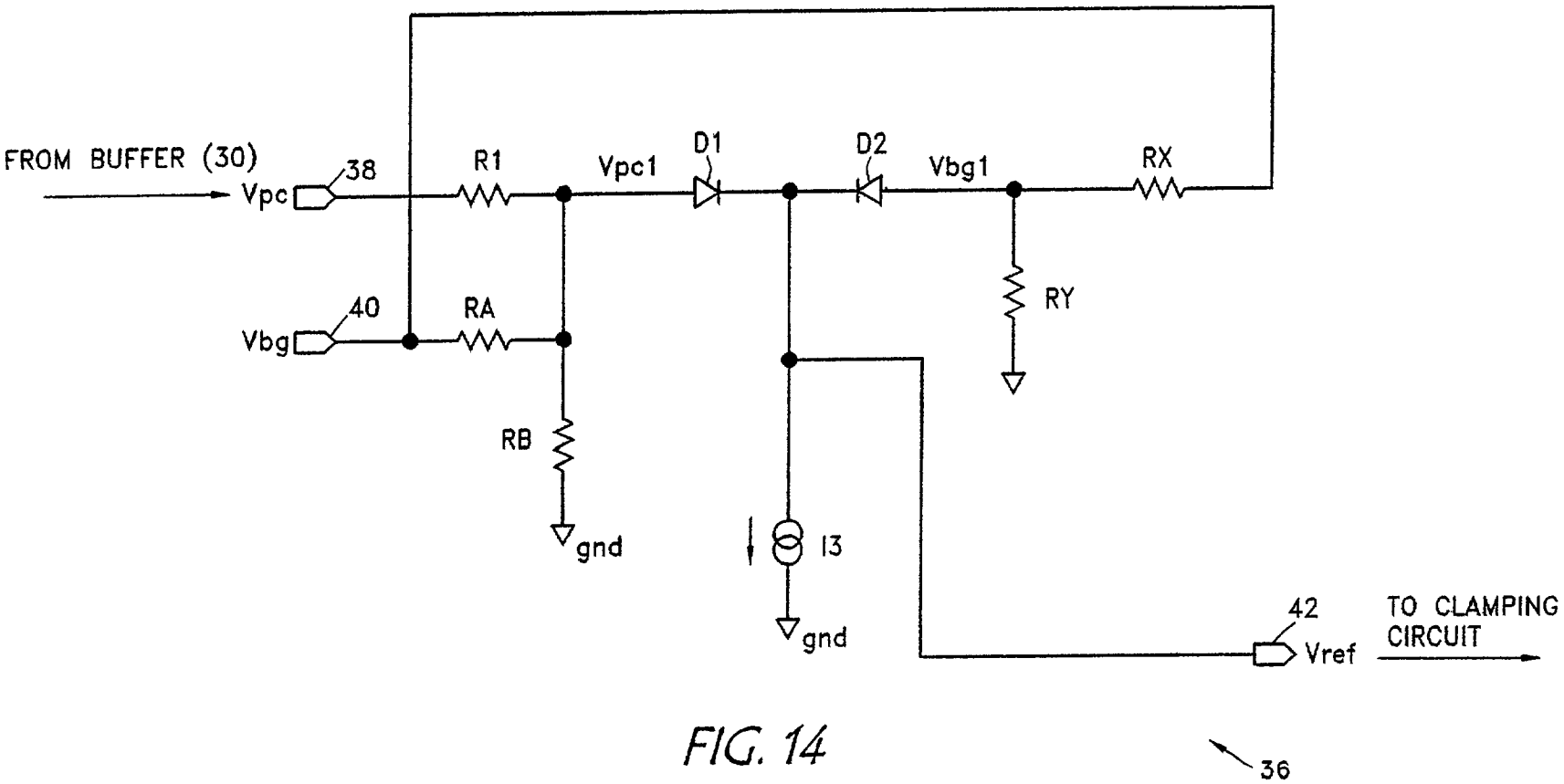
FIG. 14 is a schematic diagram illustrating the circuit structure of a further embodiment of the clamping circuit.

FIG. 13 shows a schematic diagram of another embodiment of the clamping circuit 36. In this embodiment, the clamping circuit 36 is implemented with diodes D1 and D2 instead of the transistors Q1 and Q2 of FIG. 11. For convenience, it is assumed that the input voltages of the opamps 44 and 46 are Vpc1 and Vbg1, respectively, and that the outputs of the first and second opamps 44 and 46 are Vo1 and Vo2, respectively. Also, it is assumed that the voltage in node "a" is Va. Va is input to the negative terminals of the first and second opamps 44 and 46. Since D1 and D2 have a structure in which either one will operate at one time, if Vo1 is greater than Vo2, D1 will be turned on and D2 will be turned off. In this situation, the first opamp 44 outputs Vo1[=A1×(Vpc1−Va)], where A1 is a gain of the first opamp 44 and Va is found to be (Vo1−0.7V) Combining the above two and referring to corresponding descriptions in FIG. 4, Vo1 is found to be (Va=Vref=Vpc1). If Vo2 is greater than Vo1, D2 will be turned on and D1 will be turned off. In this situation, the second opamp 46 outputs Vo2 [=A2×(Vbg1−Va)], where A2 is a gain of the second opamp 46 and Va=Vo2−0.7V. In this situation, "Vb" (=Vref) is found to be Vbg1. If proper resistor values are selected for R1, RA, RB, RX and RY, Vref is found to be (Vpc1−0.7 V) or (Vbg1−0.7 V) which is greater than Vmin FIG. 14 shows a schematic diagram of another embodiment of the clamping circuit 36. In this embodiment, the clamping circuit 36 is implemented without opamps 44 and 46. This embodiment assumes that an input voltage to the diode D1 is Vpc1, and that an input voltage to the diode D2 is Vbg1. If Vpc1>Vbg1, Vref is found to be [Vpc1−0.7 V]. If Vbg1>Vpc1, Vref is obtained as [Vbg1−0.7 V]. Similar to FIG. 7, when proper resistor values are selected for R1, RA, RB, RX and RY, Vref is obtained as (Vpc1−0.7 V) or (Vbg1−0.7 V), which is greater than Vmin.

The clamping circuits of FIGS. 5–11, and 13 include opamps 44 and 46, but the clamping circuits of FIGS. 12 and 14 do not include opamps. The clamping circuits with opamps have the advantages of higher input impedance and higher gain than those without opamps. Thus, the clamping circuits with opamps produce a sharper clamping level. Consequently, each clamping circuit 36 in FIGS. 5–14 can generate the allowable minimum voltage and provide the voltage to the boost regulator 32.

While the above description has pointed out novel features of the invention as applied to various embodiments, the skilled person will understand that various omissions, substitutions, and changes in the form and details of the device or process illustrated may be made without departing from the scope of the invention. For example, those skilled in the art will understand that the orientation, polarity, and connections of electric components in the clamping circuit is a matter of design convenience as long as the apparatus can output the minimum reference voltage for boost regulator, and will be able to adapt the details described herein to an apparatus having different components, or different polarities. Any such different configurations may therefore provide a substantially equivalent basis for providing the minimum reference voltage, and thus may be used for the purpose in alternative embodiments. All such alternative apparatus are implicitly described by extension from the description above, and are contemplated as alternative embodiments of the invention. Therefore, the scope of the invention is defined by the appended claims rather than by the foregoing description. All variations coming within the meaning and range of equivalency of the claims are embraced within their scope.

What is claimed is:

1. An apparatus for providing a reference voltage to a boost regulator that generates a drive voltage for a current source based on the reference voltage, the apparatus comprising:

a first voltage source configured to generate a constant voltage;

a second voltage source configured to generate a variable voltage; and a clamping circuit connected to each of the first and second voltage sources, and configured to generate the reference voltage based on the constant and variable voltages, said reference voltage being provided to the boost regulator at a level that is at least sufficient to cause the boost regulator to output a non-zero voltages, wherein the clamping circuit is configured to output as the reference voltage a greater one of the constant voltage and the variable voltage and wherein the clamping circuit comprises first and second components configured to receive the constant voltage and the variable voltage respectively, and third and fourth components configured to receive outputs of the first and second components respectively and to output the reference voltage to the boost regulator.

2. The apparatus of claim 1, wherein the first and second components comprise first and second opamps respectively, the first opamp being configured to receive the constant voltage in one input terminal thereof, the second opamp being configured to receive the variable voltage in one input terminal thereof, and another input terminal of the first opamp being connected to another input terminal of the second opamp.

3. The apparatus of claim 2, wherein the third and fourth components comprise first and second transistors respectively, each transistor having first, second and third terminals, each first terminal of the first and second transistors being configured to receive each output of the first and second opamps, and wherein the second and third terminals of each transistor are connected respectively to the second and third terminals of each other transistor, and the third terminals of each transistor are configured to provide the reference voltage to the boost regulator.

4. The apparatus of claim 3, wherein the transistors comprise bipolar transistors.

5. The apparatus of claim 3, wherein the transistors comprise MOS transistors.

6. The apparatus of claim 5, wherein the MOS transistors comprise PMOS transistors.

7. The apparatus of claim 5, wherein the first transistor comprises a PMOS transistor, and the second transistor comprises an NMOS transistor.

8. The apparatus of claim 2, wherein the third and fourth components comprise first and second diodes respectively, each diode having first and second terminals, the first terminals of each diode being configured to receive outputs of the first and second opamps respectively, and wherein the second terminals of each diode are connected to the second terminals of each other diode and to another input terminals of the first and second opamps, and the second terminals of the diodes are configured to provide the reference voltage to the boost regulator.

9. The apparatus of claim 1, wherein the clamping circuit comprises first and second transistors respectively, each transistor having first, second and third terminals, the first terminals of each transistor being configured to receive the constant and variable voltages respectively, and wherein the second and third terminals of each transistor are connected respectively to the second and third terminals of each other transistor, and the third terminals of the transistors are configured to provide the reference voltage to the boost regulator.

10. The apparatus of claim 1, wherein the clamping circuit comprises first and second diodes each having first and second terminals, the first terminals of each diode being configured to receive the constant and variable voltages respectively, and wherein the second terminals of each diode are connected to the second terminals of each other diode and configured to provide the reference voltage to the boost regulator.

11. The apparatus of claim 1, further comprising a display device having at least one display element, and wherein the second voltage source comprises a voltage measurement circuit which is configured to measure a representative display element voltage created when a known current conducts through the display element and to provide the representative display element voltage to the clamping circuit as the variable voltage.

12. The apparatus of claim 11, wherein the display device includes a matrix of Polymer Light Emitting Diodes (PLEDs), and the display element is a particular PLED within the matrix.

13. The apparatus of claim 11, wherein the display device includes a matrix of Organic Light Emitting Diodes (OLEDs), and the display segment is a particular OLED within the matrix.

14. The apparatus of claim 1, further comprising a display device having at least one display element, and wherein the second voltage source comprises a voltage measurement circuit which is configured to measure a representative display element voltage created when a known current conducts through the display element, and a precharge circuit connected to the voltage measurement circuit and configured to generate a precharge voltage based on the representative display element and to provide the precharge voltage to the clamping circuit as the variable voltage.

15. An apparatus for providing a reference voltage to a boost regulator that generates a drive voltage for a current source based on the reference voltage, the apparatus comprising:

a first voltage source configured to generate a constant voltage;

a second voltage source configured to generate a variable voltage;

a first modifying circuit connected to the first voltage source and configured to modify the constant voltage;

a second modifying circuit connected to the second voltage source and configured to modify the variable voltage; and a clamping circuit connected to outputs of each modifying circuit, and configured to generate the reference voltage based on the modified constant voltage and the modified variable voltage, said reference voltage being provided to the boost regulator at a level that is at least sufficient to cause the boost regulator to output a non-zero voltage.

16. The apparatus of claim 15, wherein the clamping circuit is configured to output as the reference voltage a greater one of the modified constant voltage and the modified variable voltage.

17. The apparatus of claim 16, wherein the clamping circuit comprises first and second components configured to receive the modified constant voltage and the modified variable voltage respectively, and third and fourth components configured to receive outputs of the first and second components respectively and to output the reference voltage to the boost regulator.

18. The apparatus of claim 17, wherein the first modifying circuit is configured to scale the constant voltage to a first predetermined voltage and provide the first predetermined voltage to the first component.

19. The apparatus of claim 18, wherein the first modifying circuit comprises a first resistor and a second resistor each having first and second terminals, the first terminal of the first resistor connected to the first voltage source and the second terminal of the first resistor connected to the first component, the first terminal of the second resistor connected to the second terminal of the first resistor in parallel and the second terminal of the second resistor connected to the ground.

20. The apparatus of claim 19, wherein the second modifying circuit is configured to scale the variable voltage to a second predetermined voltage and provide the second predetermined voltage to the second component.

21. The apparatus of claim 20, wherein the second modifying circuit comprises a third resistor and a fourth resistor each having first and second terminals, the first terminal of the third resistor connected to the second voltage source and the second terminal of the third resistor connected to the second component, and the first terminal of the fourth resistor connected to the second terminal of the third resistor in parallel, and the second terminal of the fourth resistor connected to the ground.

22. The apparatus of claim 19, wherein the second modifying circuit is configured to scale and offset the variable voltage to a third predetermined voltage and provide the third predetermined voltage to the second component.

23. The apparatus of claim 22, wherein the second modifying circuit comprises:

a third resistor having first and second terminals, the first terminal of the third resistor connected to the second voltage source and the second terminal of the third resistor connected to the second component;

a fourth resistor having first and second terminals, the first terminal of the fourth resistor connected to the second terminal of the third resistor in parallel, and the second terminal of the fourth resistor connected to the ground;

a voltage source configured to generate a voltage; and a fifth resistor having first and second terminals, the first terminal of the fifth resistor connected to the voltage source, the second terminal of the fifth resistor connected to the first terminal of the fourth resistor in parallel.

24. The apparatus of claim 22, wherein the second modifying circuit comprises:

a third resistor having first and second terminals, the first terminal of the third resistor connected to the second voltage source and the second terminal of the third resistor connected to the second component;

a fourth resistor having first and second terminals, and the first terminal of the fourth resistor connected to the second terminal of the third resistor in parallel, and the second terminal of the fourth resistor connected to the ground; and a current source connected to the first terminal of the fourth resistor in parallel and configured to provide an offset effect relative to the variable voltage in conjunction with the third resistor.

25. The apparatus of claim 24, wherein the first and second components comprise first and second opamps respectively, the first opamp being connected to the second terminal of the first resistor in one input terminal thereof, the second opamp being connected to the second terminal of the third resistor in one input terminal thereof, and the other input terminals of the first and second opamps being connected to each other.

26. The apparatus of claim 25, wherein the third and fourth components comprise first and second transistors respectively, each transistor having first, second and third terminals, the first terminals of the first and second transistors being connected to outputs of the first and second opamps, respectively, and the second terminals of the transistors being connected to each other through a power supply, and wherein the third terminals of the transistors are connected to each other and configured to provide the reference voltage to the boost regulator.

27. The apparatus of claim 26, wherein the transistors comprise bipolar transistors.

28. The apparatus of claim 26, wherein the transistors comprise MOS transistors.

29. The apparatus of claim 28, wherein the MOS transistors comprise PMOS transistors.

30. The apparatus of claim 28, wherein the first transistor comprises an NMOS transistor, and the second transistor comprises a PMOS transistor.

31. The apparatus of claim 15, further comprising a display device having at least one display element, and wherein the second voltage source comprises a voltage measurement circuit which is configured to measure a representative display element voltage created when a known current conducts through the display element and to provide the representative display element voltage to the clamping circuit as the variable voltage.

32. The apparatus of claim 31, wherein the display device includes a matrix of Polymer Light Emitting Diodes (PLEDs), and the display element is a particular PLED within the matrix.

33. The apparatus of claim 31, wherein the display device includes a matrix of Organic Light Emitting Diodes (OLEDs), and the display segment is a particular OLED within the matrix.

34. The apparatus of claim 15, further comprising a display device having at least one display element, and wherein the second voltage source comprises a voltage measurement circuit which is configured to measure a representative display element voltage created when a known current conducts through the display element, and a precharge circuit connected to the voltage measurement circuit and configured to generate a precharge voltage based on the representative display element and to provide the precharge voltage to the clamping circuit as the variable voltage.

35. A display apparatus having at least one display element, comprising:

a boost regulator configured to generate a drive voltage that is used for providing a current to the display element based on a reference voltage;

a sampling circuit configured to generate a representative display element voltage created when a known current conducts through the display element;

a precharge circuit connected to the output of the sampling circuit and configured to generate a precharge voltage based on the representative display element voltage;

a voltage source configured to generate a constant voltage; and a clamping circuit connected to the input of the boost regulator and configured to receive the precharge voltage and the constant voltage and to generate the reference voltage for communication to the boost regulator, said reference voltage being at a level that is at least sufficient to cause the boost regulator to output a non-zero voltages, wherein the clamping circuit is configured to provide a greater one of the constant voltage and the precharge voltage to the boost regulator as the reference voltage and wherein the clamping circuit comprises first and second components configured to receive the constant voltage and the variable voltage respectively, and third and fourth components configured to receive the outputs of the first and second components and to output the reference voltage to the boost regulator.

36. The apparatus of claim 35, wherein the first and second components comprise first and second opamps, the first opamp being configured to receive the constant voltage in one input terminal thereof, the second opamp being configured to receive the variable voltage in one input terminal thereof, and the other input terminals of the first and second opamps being connected to each other.

37. The apparatus of claim 36, wherein the third and fourth components comprise first and second transistors, the first transistor being configured to receive the output of the first opamp and the second transistor being configured to receive the output of the second opamp, and wherein the emitters and the collectors of each transistor are connected to each other and the emitters of each transistor are configured to provide the reference voltage to the boost regulator.

38. The apparatus of claim 37, wherein the transistors comprise bipolar transistors.

39. The apparatus of claim 35, wherein the clamping circuit comprises first and second transistors, the first transistor being configured to receive the constant voltage, the second transistor being configured to receive the variable voltage, and wherein the emitters and the collectors of each transistor are connected to each other and the emitters of each transistor are configured to provide the reference voltage to the boost regulator.

40. The apparatus of claim 35, wherein the clamping circuit comprises first and second diodes, the first diode being configured to receive the constant voltage and the second diode being configured to receive the variable voltage, and wherein cathode terminals of the first and second diodes are connected to each other and configured to provide the reference voltage to the boost regulator.

41. The apparatus of claim 35, wherein the display apparatus includes a matrix of Polymer Light Emitting Diodes (PLEDs), and the display element is a particular PLED within the matrix.

42. The apparatus of claim 35, wherein the display device includes a matrix of Organic Light Emitting Diodes (OLEDs), and the display element is a particular OLED within the matrix.

43. An apparatus for driving a display device having at least one display element, the apparatus comprising:

a boost regulator configured to generate a drive voltage that is used for providing a current to the display element based on a reference voltage;

a first voltage source configured to generate a constant voltage;

a second voltage source configured to generate a variable voltage; and a clamping circuit connected to each of the first and second voltage sources, and to an input of the boost regulator, the clamping circuit being configured to receive the constant voltage from the first voltage source and the variable voltage from the second voltage source, the clamping circuit being further configured to generate the reference voltage based on the constant and variable voltages, wherein said reference voltage is provided to the boost regulator at a level that is at least sufficient to cause the boost regulator to output a non-zero voltage, wherein the clamping circuit comprises first and second components configured to receive the constant voltage and the variable voltage respectively, and third and fourth components configured to receive outputs of the first and second components respectively and to output the reference voltage to the boost regulator.

44. The apparatus of claim 43, wherein the clamping circuit is configured to output a greater one of the constant voltage and the variable voltage.

45. The apparatus of claim 43, wherein the variable voltage source comprises a voltage measurement circuit that is configured to measure a representative display element voltage created when a known current conducts through the display element and to provide the representative display element voltage to the clamping circuit as the variable voltage.

46. The apparatus of claim 43, wherein the display device includes a matrix of Polymer Light Emitting Diodes (PLEDs), and the display element is a particular PLED within the matrix.

47. An apparatus for driving a display device having at least one display element that includes first and second terminal regions, the apparatus comprising:

a boost regulator configured to generate a drive voltage based on a reference voltage;

a first current driver circuit connected to an output of the boost regulator, and configured to generate a first current based on the drive voltage and to provide the first current to the first terminal;

a second current driver circuit connected to the second terminal region, and configured to cause the first current to flow through the display element;

a sampling circuit connected to the display element and configured to sample a representative display element voltage when the first current conducts through the display element;

a precharge circuit connected to the sampling circuit and configured to generate a precharge voltage based on the representative display element voltage;

a voltage source configured to generate a constant voltage; and a clamping circuit connected to the precharge circuit and the voltage source, and configured to generate the reference voltage based on the precharge and constant voltages, said reference voltage being provided to the boost regulator at a level that is at least sufficient to cause the boost regulator to output a non-zero voltage.

48. The apparatus of claim 47, wherein the clamping circuit is configured to output as the reference voltage a greater one of the constant voltage and the precharge voltage.

49. The apparatus of claim 47, wherein the display device includes a matrix of Organic Light Emitting Diodes (OLEDs), and the display element is a particular OLED within the matrix.

50. An apparatus for providing a reference voltage to a boost regulator having an input terminal, the boost regulator being configured to generate a drive voltage for a current source based on the reference voltage, the apparatus comprising:

a first voltage source configured to generate a constant voltage;

a second voltage source configured to generate a variable voltage; and a clamping voltage generator having first and second input terminals connected to the first voltage source and the second voltage source, respectively, and further having an output terminal connected to the input terminal of the boost regulator, wherein the clamping voltage generator is configured to generate the reference voltage based on the constant and variable voltages, said reference voltage being provided to the boost regulator at a level that is at least sufficient to cause the boost regulator to output a non-zero voltage wherein the clamping voltage generator comprises first and second components configured to receive the constant voltage and the variable voltage respectively, and third and fourth components configured to receive outputs of the first and second components respectively and to output the reference voltage to the boost regulator.

51. The apparatus of claim 50, wherein the clamping voltage generator is configured to output as the reference voltage a greater one of the constant voltage and the variable voltage.

52. An apparatus for providing a reference voltage to a boost regulator that generates a drive voltage for a current source based on the reference voltage, the apparatus comprising:

means for generating a constant voltage;

means for generating a variable voltage;

means for modifying the constant voltage;

means for modifying the variable voltage;

means for generating the reference voltage based on the modified constant and modified variable voltages, said reference voltage being at a level that is at least sufficient to cause the boost regulator to output a non-zero voltage; and means for providing the reference voltage to the boost regulator.

53. An apparatus for driving a display device having at least one display element and a boost regulator which generates a drive voltage for a current to the display element based on a reference voltage, the apparatus comprising:

means for conducting a known current through the display element to generate at least a display element voltage;

means for sampling a representative voltage from the display element voltage;

means for providing a precharge voltage based on the representative voltage;

means for generating a constant voltage;

means for modifying the constant voltage;

means for modifying the precharge voltage;

means for generating the reference voltage based on the modified precharge voltage and the modified constant voltage, said reference voltage being at a level that is at least sufficient to cause the boost regulator to output a non-zero voltage; and means for providing the reference voltage to the boost regulator.

54. An apparatus for providing a reference voltage to a boost regulator that generates a drive voltage for a current source based on the reference voltage, the apparatus comprising:

a first voltage source configured to generate a constant voltage;

a second voltage source configured to generate a variable voltage;

a first modifying circuit connected to the first voltage source and configured to modify the constant voltage;

a second modifying circuit connected to the second voltage source and configured to modify the variable voltage; and a clamping circuit connected to outputs of the first and second modifying circuits, and configured to generate the reference voltage based on the modified constant voltage and the modified variable voltage, said reference voltage being provided to the boost regulator at a level that is sufficient to enable the operation of the boost regulator.

55. A method for providing a reference voltage for a boost regulator that generates a drive voltage for a current source based on the reference voltage, the method comprising:

generating a constant voltage;

generating a variable voltage;

modifying the constant voltage;

modifying the precharge voltage;

generating the reference voltage based on the modified constant and modified variable voltages, said reference voltage being at a level that is at least sufficient to cause the boost regulator to output a non-zero voltage; and providing the reference voltage to the boost regulator.

56. The method of claim 55, wherein the act of generating the reference voltage comprises providing a greater one of the constant voltage and the variable voltage.

57. The method of claim 55, further comprising providing a display device having at least one display element and wherein the act of generating the variable voltage comprises measuring a representative display element voltage created when a known current conducts through the display element.

58. The method of claim 57, wherein the display device includes a matrix of Polymer Light Emitting Diodes (PLEDs), and the display element is a particular PLED within the matrix.

59. A method of driving a display device having at least one display element and a boost regulator which generates a drive voltage for a current to the display element based on a reference voltage, the method comprising:

conducting a known current through the display element to generate at least a display element voltage;

sampling a representative voltage from the display element voltage;

providing a precharge voltage based on the representative voltage;

generating a constant voltage;

modifying the constant voltage;

modifying the precharge voltage;

generating the reference voltage based on the modified precharge voltage and the modified constant voltage, said reference voltage being at a level that is at least sufficient to cause the boost regulator to output a non-zero voltage; and providing the reference voltage to the boost regulator.

60. The method of claim 59, wherein the act of generating the reference voltage comprises providing a greater one of the constant voltage and the precharge voltage.

61. A method for providing a reference voltage for a boost regulator that generates a drive voltage for a current source based on the reference voltage, the method comprising:

generating a constant voltage;

generating a variable voltage;

modifying the constant voltage to a first predetermined voltage;

modifying the variable voltage to a second predetermined voltage;

generating the reference voltage based on the first and second predetermined voltages, said reference voltage being at a level that is at least sufficient to cause the boost regulator to output a non-zero voltage; and providing the reference voltage to the boost regulator.

62. The method of claim 61, wherein the act of modifying the constant voltage comprises scaling the constant voltage to the first predetermined voltage.

63. The method of claim 61, wherein the act of modifying the variable voltage comprises scaling the variable voltage to the second predetermined voltage.

64. The method of claim 61, wherein the act of modifying the variable voltage comprises scaling and offsetting the variable voltage to the second predetermined voltage.

65. The method of claim 61, wherein the act of generating the reference voltage comprises providing a greater one of the first and second predetermined voltages.

66. A method for providing a reference voltage for a boost regulator that generates a drive voltage for a current source based on the reference voltage, the method comprising:

generating a constant voltage;

generating a variable voltage;

modifying the constant voltage;

modifying the precharge voltage;

generating the reference voltage based on the modified constant and modified variable voltages, said reference voltage being at a level that is suitable to enable the operation of the boost regulator.

67. A method for providing a reference voltage for a boost regulator that generates a drive voltage for a current source based on the reference voltage, the method comprising:

generating a constant voltage;

generating a variable voltage;

modifying the constant voltage to a first predetermined voltage;

modifying the variable voltage to a second predetermined voltage;

generating the reference voltage based on the first and second predetermined voltages, said reference voltage being at a level that is suitable to enable the operation of the boost regulator; and providing the reference voltage to the boost regulator.

* * * * *